US011713065B2

(12) United States Patent
Kinio et al.

(10) Patent No.: US 11,713,065 B2
(45) Date of Patent: Aug. 1, 2023

(54) METHOD FOR CBTC SYSTEM MIGRATION USING AUTONOMY PLATFORM

(71) Applicant: THALES CANADA INC., Toronto (CA)

(72) Inventors: Walter Kinio, Toronto (CA); Rudy Rochefort, Toronto (CA); Alon Green, Toronto (CA)

(73) Assignee: THALES CANADA INC., Toronto (CA)

( * ) Notice: Subject to any disclaimer, the term of this patent is extended or adjusted under 35 U.S.C. 154(b) by 462 days.

(21) Appl. No.: 17/073,182

(22) Filed: Oct. 16, 2020

(65) Prior Publication Data

US 2021/0114640 A1 Apr. 22, 2021

Related U.S. Application Data

(60) Provisional application No. 62/916,705, filed on Oct. 17, 2019.

(51) Int. Cl.
*B61L 27/60* (2022.01)
*B61L 27/04* (2006.01)
(Continued)

(52) U.S. Cl.
CPC ..... *B61L 27/60* (2022.01); *B61L 23/04* (2013.01); *B61L 27/04* (2013.01); *B61L 27/70* (2022.01); *B61L 2201/00* (2013.01)

(58) Field of Classification Search
CPC ..... B61L 27/60; B61L 27/04; B61L 27/70; B61L 27/20; B61L 27/37; B61L 23/04;
(Continued)

(56) References Cited

U.S. PATENT DOCUMENTS 6,459,965 B1 10/2002 Polivka et al.
6,681,160 B2 1/2004 Bidaud
(Continued)

FOREIGN PATENT DOCUMENTS

CN 204993362 U 1/2016
EP 2765053 A2 8/2014
(Continued)

OTHER PUBLICATIONS

Zhu et al, L. Design Performance Enhancements in Communication-Based Train Control Systems with Coordinated Multipoint Transmission and Reception, IEEE Transactions on Intelligent Transportation Systems, vol. 5, No. 3, Jun. 2014, pp. 1258-1272. (Year: 2014).*

(Continued)

*Primary Examiner* — Russell Frejd
(74) *Attorney, Agent, or Firm* — Hauptman Ham, LLP

(57) ABSTRACT

A method of communication-based train control system migration includes scanning a guideway to generate surveying data and processing surveying data to calculate a 3-D representation of the guideway. Appropriate locations are determined for the communication-based control devices on the guideway. Communication-based train control devices are installed in a guideway at the determined appropriate locations and vehicles are retrofitted with an autonomy platform. Testing of the control devices and retrofit vehicles is performed. A communication-based train control system is used to control the retrofit vehicles when they operate within the guideway.

20 Claims, 15 Drawing Sheets

(51) Int. Cl.
*B61L 23/04* (2006.01)
*B61L 27/70* (2022.01)

(58) Field of Classification Search
CPC ..... B61L 2201/00; B61L 2027/204; B61L 15/0027
See application file for complete search history.

(56) References Cited

U.S. PATENT DOCUMENTS

| | | | | |
|---|---|---|---|---|
| 6,694,231 | B1 | 2/2004 | Rezk | |
| 8,200,380 | B2 * | 6/2012 | Ghaly | B61C 17/12 701/19 |
| 8,296,065 | B2 | 10/2012 | Haynie et al. | |
| 8,651,433 | B2 * | 2/2014 | Ghaly | B61L 3/125 701/19 |
| 9,290,191 | B2 * | 3/2016 | Ghaly | B61L 3/008 |
| 9,434,397 | B2 | 9/2016 | Chung et al. | |
| 9,469,317 | B2 | 10/2016 | Kernwein | |
| 9,533,626 | B2 * | 1/2017 | Forni | B61L 23/041 |
| 9,623,885 | B1 | 4/2017 | Shubs, Jr. et al. | |
| 9,711,046 | B2 | 7/2017 | Shubs, Jr. | |
| 9,950,718 | B2 | 4/2018 | Naylor | |
| 10,081,376 | B2 | 9/2018 | Singh | |
| 10,392,040 | B2 | 8/2019 | Oswald et al. | |
| 2004/0049327 | A1 * | 3/2004 | Kondratenko | B61L 27/37 701/19 |
| 2015/0142225 | A1 * | 5/2015 | Tonguz | B61L 19/06 701/19 |
| 2016/0318530 | A1 | 11/2016 | Johnson | |
| 2018/0222505 | A1 | 8/2018 | Chung et al. | |
| 2019/0054942 | A1 | 2/2019 | Carlson | |

FOREIGN PATENT DOCUMENTS

| | | | |
|---|---|---|---|
| GB | 2416864 | A | 2/2006 |
| WO | 2019185872 | A1 | 10/2019 |

OTHER PUBLICATIONS

Shirlaw, S.G., Radio and Communications-based Train Control: Migration, Interoperation and System Engineering Issues, IET, 2008 International Conference on Railway Engineering—Challenges for Railway Transportation in Information Age, pp. 1-5. (Year: 2008).*

Schaefer et al, E., Engineering the CBTC Interface with the NYCT R143 Vehicle, Google Scholar, Proceedings of the 2001 IEEE/ASME Joint Railroad Conference, Apr. 2001, pp. 17-28. (Year: 2001).*

Keevill, D., Communication Based Train Control Technology Selection, Google Scholar, Proceedings of the 2014 ASME/IEEE Joint Rail Conference, Apr. 2014, pp. 1-17. (Year: 2014).*

Farooq et al., Jahanzeb, "Radio Communication for Communications-Based Train Control (CBTC): A Tutorial and Survey," IEEE Communications Surveys & Tutorials, 19.3 (2017): 1377-1402.

Choo, Siew Aun, "Challenges in Implementing a New Signalling To System Replace an Existing Signalling System While Maintaining Normal Train Service," IRSE (2017), SMRT Trains Ltd., Singapore.

* cited by examiner

METHOD FOR CBTC SYSTEM MIGRATION USING AUTONOMY PLATFORM

PRIORITY CLAIM

The present application claims the priority of U.S. Provisional Application No. 62/916,705, filed Oct. 17, 2019, which is incorporated herein by reference in its entirety.

BACKGROUND

When an existing signaling system (a legacy system) is migrated into a communication based train control (CBTC) system, the legacy system, either completely or section by section, has to shut down for a significant period of time, or alternatively a short shut down period (e.g., a few hours per day) is enforced for even longer period of time to gradually complete the migration activity. The migration process is lengthy, inefficient and painful to the end user operating or using the system, and especially costly due to interruptions to the revenue service required to support the migration activities. No benefit is derived from the CBTC system until all elements in a migration section and a sufficient number of trains have been commissioned with CBTC equipment to run service using the CBTC system.

A CBTC system supports automatic train protection (ATP), automatic train operation (ATO) and automatic train supervision (ATS) functions as defined in IEEE 1474. In order for the train to operate under manual control, driverless train operation (DTO) or unattended train operation (UTO) under the protection of the CBTC system, communications between the on-board CBTC system and trackside/central CBTC system is required and confirmation that the on-board CBTC system has established the vehicle position is also required. If position is not established or communication is not available, the vehicle has to be manually driven under partial protection from the CBTC system, typically using vehicle tracking based on track circuits or axle counting blocks occupancies and trackside automatic train protection such as trip stops.

DETAILED DESCRIPTION

Figure 1:
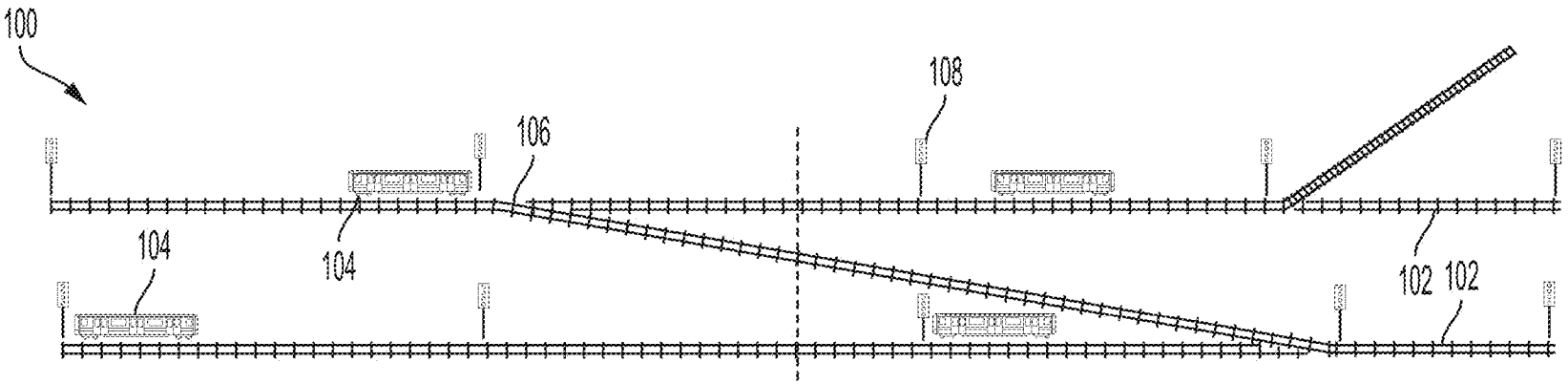
FIG. 1 is a top view of an exemplary legacy guideway topology.

The following disclosure provides many different embodiments, or examples, for implementing different features of the provided subject matter. Specific examples of components, values, operations, materials, arrangements, or the like, are described below to simplify the present disclosure. These are, of course, merely examples and are not intended to be limiting. Other components, values, operations, materials, arrangements, etc., are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Some of the systems and units employed are certified as Safety Integrity Level 4 (SIL 4) based on International Electrotechnical Commission (IEC) standard IEC 61508 and EN 50126 and EN 50129. SIL 4 means that the failure probability per hour is in the range of $10^{-8}$ to $10^{-9}$.

FIG. 1 is a top view of an exemplary legacy guideway topology 100 including tracks 102, vehicles 104, switches 106, and signals 108. A guideway topology includes trip stops and other signaling equipment (not illustrated). The dotted line in the center of Figurel represents the boundary between two migration territories.

In some embodiments, the vehicles are trains, monorails, magnetic guided vehicles, cars or other automotive vehicles, railcars or other suitable vehicles.

In some embodiments, a guideway is a track, rail, roadway, cable, series of reflectors, series of signs, a visible or invisible path, a projected path, a laser-guided path, a global positioning system (GPS)-directed path, an object-studded path or other suitable format of guide, path, track, road or the like on which, over which, below which, beside which, or along which a vehicle is caused to travel. The guideway may be train tracks, although it could be other forms of guideway such as rails, concrete viaduct, monorails, or roads with all changes in lane or track limited to fixed locations referred to as switches.

A railroad switch 106 is a mechanical installation enabling railway trains to be guided from one track to another, such as at a railway junction or where a spur or siding branches off. In accordance with various embodiments, switch 106 is a right-handed switch, a left-handed switch, a slip switch, a double slip switch, a single slip switch, an outside slip switch, a crossover switch, a stub switch, a three-way switch, a plate switch, an off-railer, an interlaced turnout, a Wye switch or any other suitable switching mechanism.

A railway signal 108 is a visual display device that conveys instructions or provides advance warning of instructions regarding the driver's authority to proceed. The driver interprets the signal's indication and acts accordingly. Typically, a signal might inform the driver of the speed at which the train may safely proceed or it may instruct the driver to stop. In accordance with various embodiments, railway signals 108 are mechanical signals, colour light signals, position light signals, colour-position signals or any other suitable signaling devices.

Figure 2:
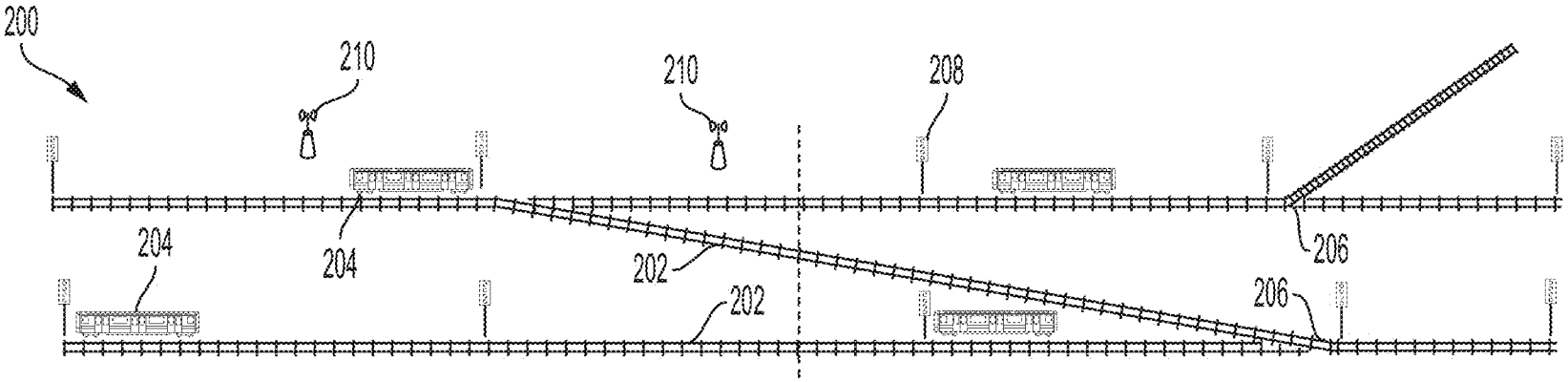
FIG. 2 is a top view of a guideway topology after progressive installation of CBTC trackside equipment, in accordance with some embodiments.

FIG. 2 is a top view of a guideway topology 200 after progressive installation of CBTC trackside equipment 210. The guideway topology 200 includes tracks 202, vehicles 204, switches 206, and signals 208. CBTC trackside equipment 210 includes radios (as shown) and/or other types of trackside equipment such as beacons, retroreflectors and signs (not shown).

Data necessary for the decision where to optimally install CBTC trackside equipment 210 such as radios, radar's retroreflectors, signs such as quick response signs, light detection and ranging (LiDAR) retroreflectors and ultra-wide band (UWB) beacons (Anchors) and for creating a CBTC system database is collected during non-revenue and/or revenue hours with LIDAR based surveying equipment installed on vehicles (revenue vehicles or special test vehicles) 204. The survey data is collected in one sweep by a dedicated operation or is accumulated from multiple train sweeps via non-intrusive 'shadow' operation.

Trackside devices 210 associated with the CBTC system (such as radios, UWB beacons, retroreflectors and signs) are installed according to an installation schema with preference to install these devices nearby the tracks 202. I.e., not between the two running rails and as close as possible to the tracks without interfering with the vehicle's dynamic envelope.

CBTC trackside equipment 210, to be installed on the trackside 202 or near the trackside, is prepared in advance in such a way that the actual installation time in the field is minimized and is completed within a short time window (less than 4 hours) during non-revenue hours or if the system is a twenty four hours a day, seven days a week (24/7) operating system, then the down time is as short as possible.

Optimal installation location for trackside devices 210 required for the CBTC system such as radios, beacons, retroreflectors and signs, is determined early in the process without any interruption to revenue service. Trackside devices 210 required for the CBTC system such as radios, beacons, retroreflectors and signs, are installed in their optimal location using incremental approach (geographical section by geographical section) with minimal interruption to revenue service.

A guideway survey is performed early in the project life cycle creating a 3-D guideway map database with the locations of all legacy trackside devices 206, 208 and the line of sight (LOS) distance at each location. The survey is performed with no interruption to revenue service either by a revenue service vehicle equipped (temporarily) with the surveying equipment or by a dedicated surveying vehicle operating during revenue hours.

The LOS distance determination at the early stage of the project drives the radios (communications), UWB beacons (positioning), retroreflectors (positioning) and signs (positioning, speed limits, etc.) installation schema to minimize the number of installed trackside equipment and still have sufficient coverage for reliable CBTC operation.

Figure 3:
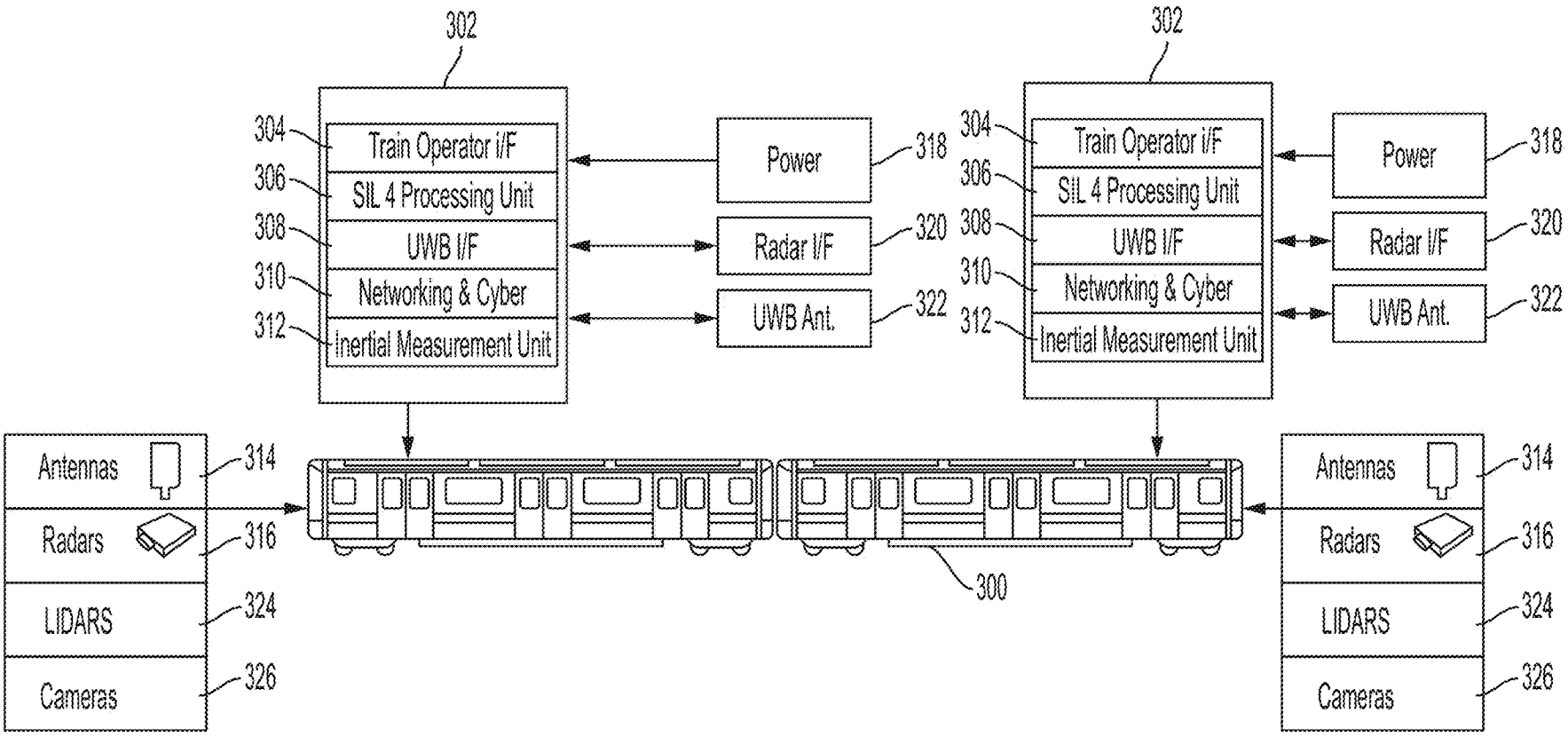
FIG. 3 is a side view of a vehicle 300 with a progressive retrofit to a CBTC system, in accordance with an embodiment.

FIG. 3 is a side view of a vehicle 300 with a complete progressive retrofit to a CBTC system, in accordance with an embodiment. At each end of the vehicle 300, an autonomy platform 302 is installed. The autonomy platform 302 includes a train operator interface 304, a SIL 4 processing unit 306, an ultra-wideband (UWB) interface 308, networking and cyber hardware 310 and an inertial measurement unit 312. The autonomy platform 302 is connected to a power source 318, a radar interface 320 and an UWB antenna 322. Communication hardware, including antennas 314 and radars 316, LIDARs 324 and cameras 326 are installed at each end of the vehicle 300. An emergency braking system (EB), not shown, is installed to provide ATP.

The CBTC system migration method includes the selection of on-board sensors and their associated trackside devices with preference to non-wheel/axle/bogie sensors. These sensors and devices include an inertial measurement unit IMU 312, radar, i.e., radar 316 and associated retroreflectors, UWB beacons, i.e. UWB antenna 322, and its associated UWB Anchors, LiDAR 324 and its associated retroreflector or landmark, camera 326 and its associated sign or landmark (not shown).

On-board sensors, i.e., radar 316, to be installed on vehicles, i.e., vehicle 300, are prepared in advance in such a way (i.e. by only mounting equipment on the car body) that the actual installation time is minimized and is completed within a short time window.

An autonomy platform 302 is installed on vehicles 300, prepared in advance in such a way that the actual installation time is minimized and is completed within a short time window. The autonomy platform 302 is capable of speed and location determination, ATO control of the train, computer vision-based capabilities such as signal aspect and landmark detection as well as emergency brake application.

Figure 4:
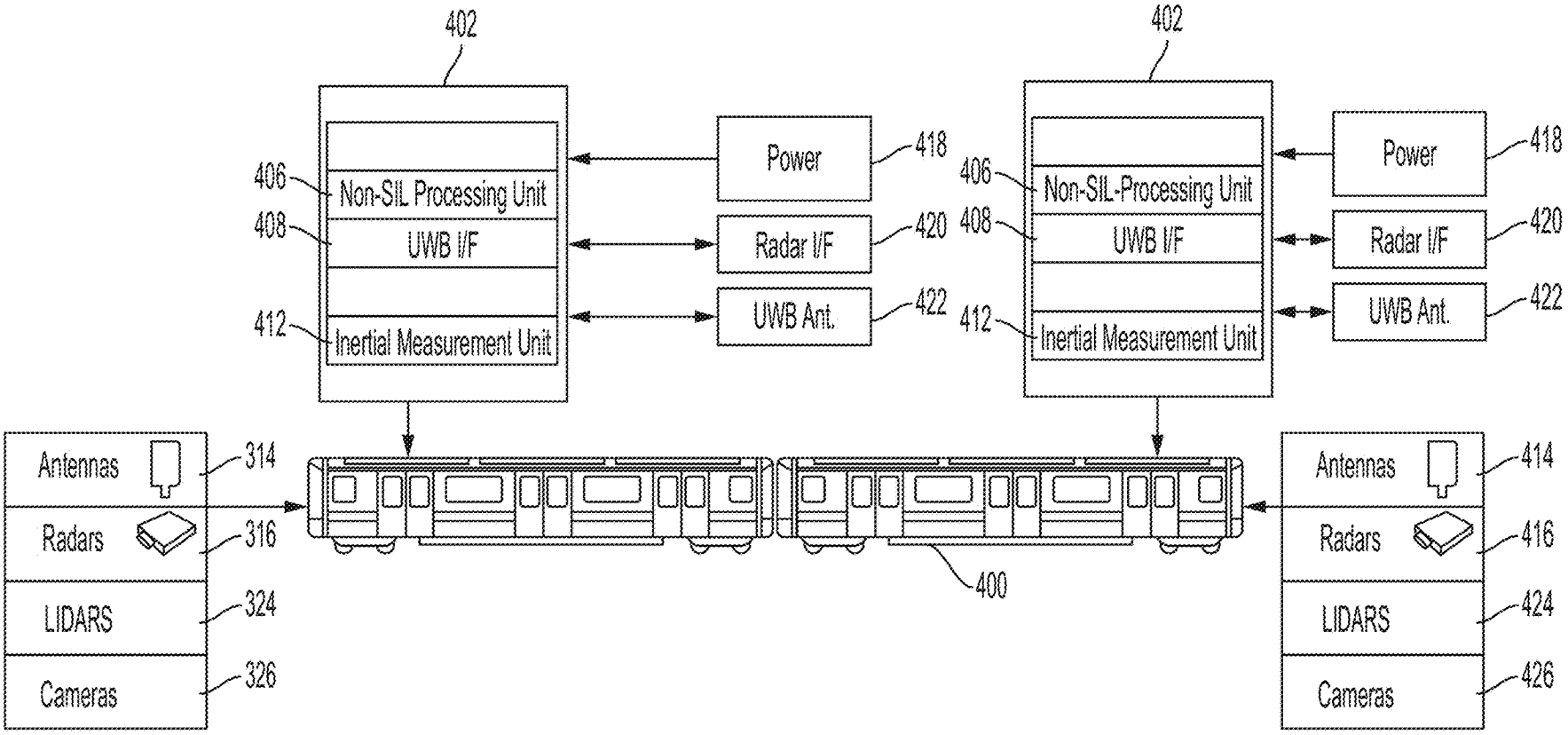
FIG. 4 is a side view of a progressive vehicle retrofit to a CBTC system, in accordance with some embodiments.

FIG. 4 is a side view of a vehicle 400 with an incremental progressive retrofit to a CBTC system, in accordance with an embodiment. At each end of the vehicle 400, an incremental control system 402 is installed. The incremental control system 402 includes non-SIL 4 processing unit 406, an ultra-wideband (UWB) interface 408, and an inertial measurement unit 412. The incremental control system 402 is connected to a power source 418, a radar interface 420 and an UWB antenna 422. Communication hardware, including antennas 414 and radars 416, LIDARs 424 and cameras 426 are installed at each end of the vehicle 400. This installation provides the ability to conduct shadow mode tests using the on-board CBTC sensors 408, 412, 416 and a non-SIL computer 406.

Non-SIL on-board computer, 406 is installed in some vehicles 400 to log sensors data and perform on-board ATP functions, are used to test the CBTC system in shadow mode. Even though this computer does not have to provide SIL 4 functions it has to meet the environmental standards (in terms of temperature, humidity, shock, vibrations and EMI/EMC) that railway on-board equipment is expected to meet, the reliability MTBF expected from railway on-board equipment (typically >150000 hours, preferably >500000 hours), the safety isolation standards expected from railway on-board equipment (typically 1500 V input to output, 1500 V input to chassis and 1500 V output to chassis), isolated and non-interference with vital trainlines and control commands such as EB, as small as possible size (preferably 1U, <19") with simple interface to the vehicle (DC power input and connectivity to the vehicle's radio/network, preferably Ethernet).

The minimum viable sensors needed to provide position and speed ATP functions are UWB beacon 422, IMU 412, and radar 416 with their associated trackside devices, i.e. trackside devices 910. More advanced deployment includes LiDAR and camera too. In some deployments even though the LiDAR and camera are not included in the minimum viable sensors set, the LiDAR and/or camera are installed on some vehicles to serve as ground truth system.

As trains 400 are equipped, the trains use autonomous features such as autonomous ATO combined with signal aspect recognition to provide an improved mode of operation prior to full or sectional commissioning of CBTC.

After trains 400 are equipped, the trains go back into revenue service with the existing system while data is collected to support the data gathering and reliability growth of the new system.

Vehicles 400 are retrofitted in an incremental approach minimizing the vehicle down-time due to the retrofit process. No wheel, axle or bogie mounted sensors are installed. Sensors 416 are installed and PICO tested without any interruption to revenue service. Installation of the complete on-board system, i.e., autonomous platform 302 (SIL 4 on-board controller, vehicle network, and control interfaces such as EB, propulsion and braking) in the vehicle 400 is not necessary for verification of the position and speed system. A non-SIL 4 computing platform 406 is sufficient for this purpose.

Verification of the on-board ATP functions such as positioning, speed, over speed supervision and obstacle avoidance is performed without interruption to revenue service. A non-SIL computer 406 installed on-board the vehicle 400 is used to execute the ATP functions, building up the confidence in the safety properties ("safety case") of the CBTC system ATP functions while the existing legacy system is still in control.

The "vehicle model" to be used in the ATO functions is created without interruption to revenue service using a non-SIL computer 406 which records the propulsion and braking efforts commands issued by the driver or the existing legacy controller and the speed, position and acceleration calculated based on the installed sensors 416.

Integration of the autonomy platform 302 including SIL-4 on-board controller 306, vehicle network 310, and control interfaces 304 such as EB, propulsion and braking allows the system to verify the complete set of ATP and ATO functions and is performed later in the process with minimal interruption to revenue service.

Early beneficial deployment of some features such as ATO by relying upon train autonomy capabilities to allow trains to interoperate with legacy signaling until new CBTC equipment is available.

Figure 5:
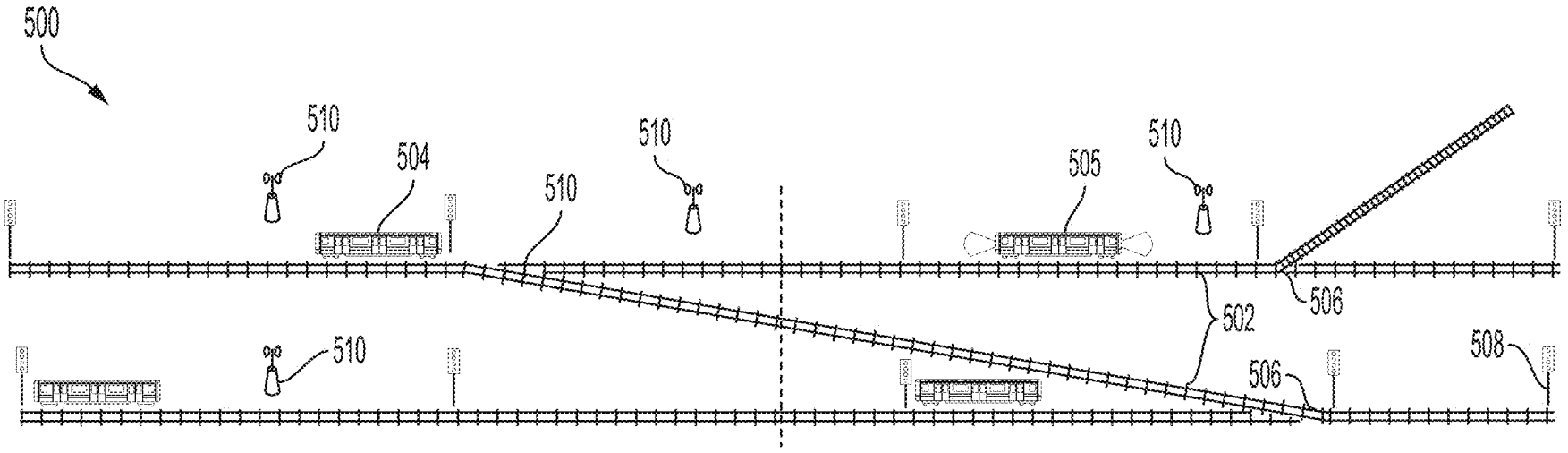
FIG. 5 is a top view of a guideway topology with progressive CBTC on-board ATP functions with post-installation check out (PICO) verification, in accordance with some embodiments.

FIG. 5 is a top view of a guideway topology 500 with progressive CBTC on-board ATP functions for post-installation check out (PICO) verification, in accordance with some embodiments. The guideway topology 500 includes tracks 502, legacy vehicles 504, a retrofit vehicle 505, switches 506, signals 508 and CBTC trackside equipment 510. The guideway topology 500 depicts an early stage of retrofit where part of the guideway topology has been retrofitted to include CBTC trackside equipment 510 and a single retrofit vehicle 505. Although only part of the retrofit has been completed, the retrofit at this stage allows progressive verification of the on-board CBTC ATP functions for the retrofit vehicle 505 and PICO tests for the CBTC trackside equipment 510.

Figure 6:
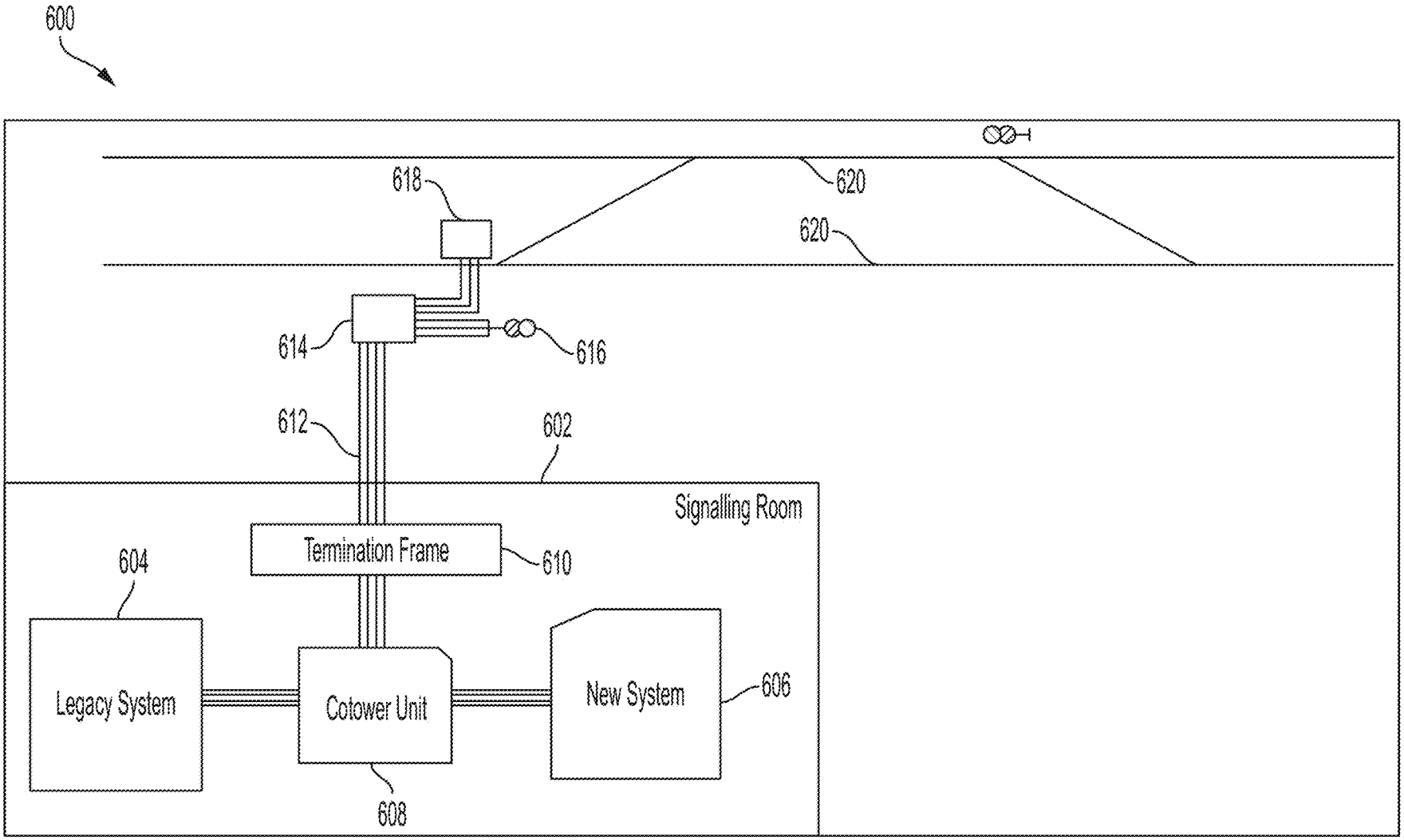
FIG. 6 is a signal room based cutover system, in accordance with an embodiment.

FIG. 6 is a signal room based cutover system 600, in accordance with an embodiment. The cutover system 600 is used to commission an installed CBTC system 606 and de-commission the existing legacy system 604. In a signaling room 602, a legacy system 604 and a CBTC system 606 are each communicably connected to a cutover unit 608. The cutover unit communicates through a termination frame 610 over control cables 612 to a junction box 614. The junction box 614 is connected to a signal 616 and a switch machine 618 alongside a track 620.

In a conventional cutover approach, the cutover occurs in the signaling room 606. Space may be unavailable in the signaling room 606 unless modifications are made to the signaling room 606 and additional power is needed to support the additional hardware. The signaling room 606 remains active during railway operation, so access to the signaling room 606 may be restricted. Copper control cabling 612 to the field is renewed as part of the upgrade. Existing cables are used for a period of time until new cabling is installed. The cutover unit 608 is used to transfer control between the legacy system 604 and the CBTC system 606. It is initially connected to legacy cables and the connections are updated with new cabling is installed. After the CBTC system 606 is commissioned, the room cabling is re-routed to the CBTC system 606 and the legacy system 604 and cutover unit 608 is removed.

Figure 7:
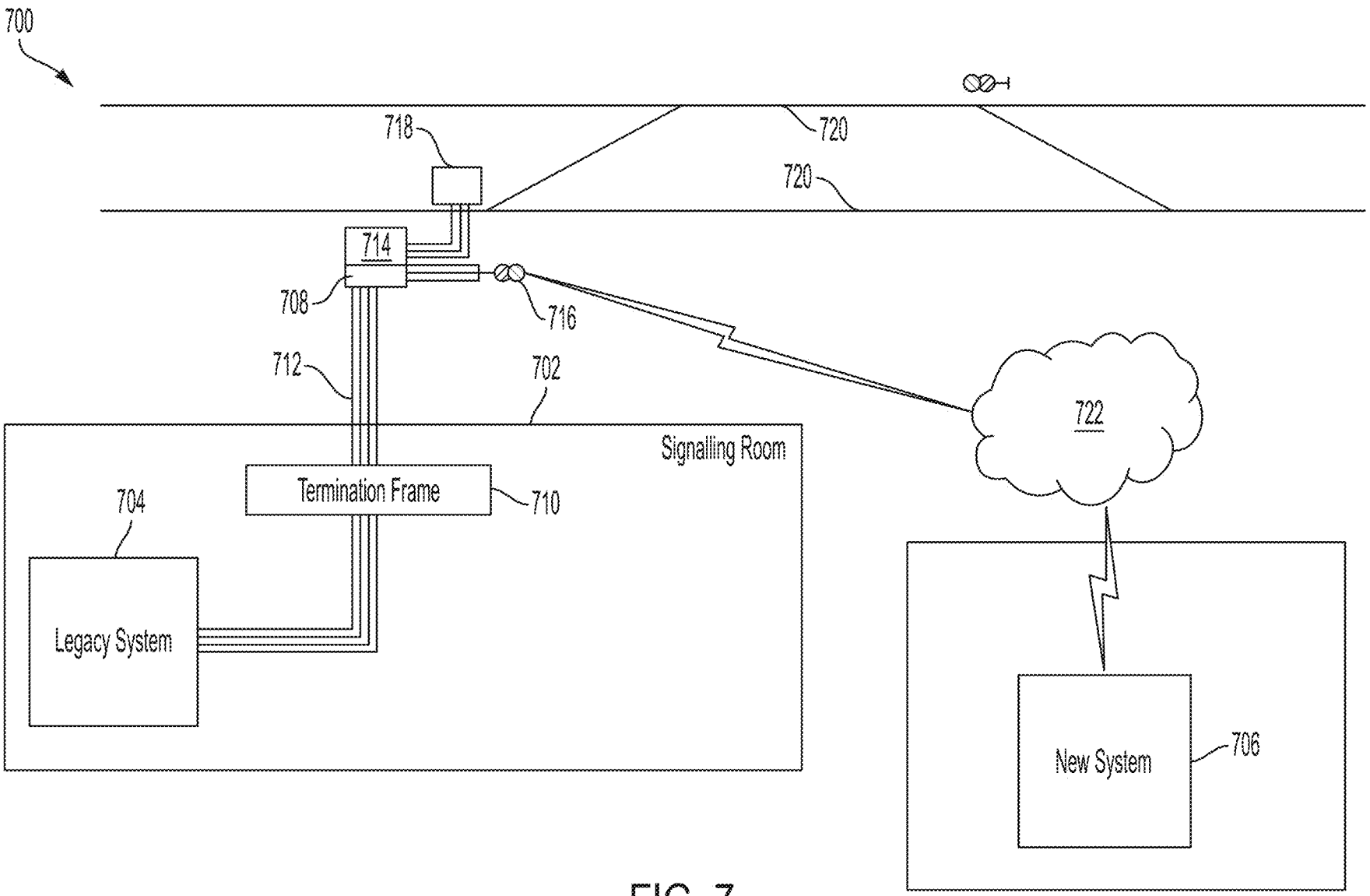
FIG. 7 is a remote IO cutover system, in accordance with an embodiment.

FIG. 7 is a remote IO based cutover system 700, in accordance with an embodiment. In a signaling room 702, a legacy system 704 communicates through a termination frame 710 over control cables 712 to a cutover unit 708 connected to a wayside object controller 714. A CBTC system 706, at another location, is communicably connected to the object controller 714 through a network 722. The wayside object controller 714 is connected to a signal 716 and a switch machine 718 alongside a track 720.

In a cloud based cutover approach, the cutover occurs in the field close to the equipment. The physical space and power requirements of signaling room 702 are unchanged from their legacy operations. The need for supporting infrastructure upgrades such as power, network, control and cable renewals, etc. for the CBTC system 706 is reduced compared to the requirements of legacy system 704 operation. Cable 712, that runs to the existing signaling room 702, are taken off-line and removed (decommissioned) after the CBTC system 706 is given functional control of the railway (commissioned). The object controller 714 is connected to other CBTC elements (not shown) through the network 722.

The object controller cutover unit 708 interfaces to the trackside devices 718 and the legacy signaling system 716.

The object controller cutover unit 708 includes a switcher mechanism, typically a safety critical circuit, which is based on vital relays, which determines the signaling system state: "Legacy" or "CBTC".

In the "Legacy" state, control commands to the trackside devices 714 are executed only if the source of the control commands is the legacy signaling system 704. It must be ensured in this state that no control command from the CBTC system 706 is executed. In this state, trackside device status is available both to the legacy and CBTC systems.

In the "CBTC" state, control commands to the trackside devices 714 are executed only if the source of the control commands is the CBTC system 706. In this state, no control command from the legacy signaling system 704 is executed.

Trackside devices 716 are controlled via object controller 714 based on Remote I/O (RIO) installed in the vicinity of the trackside devices 716 but sufficiently far from the tracks 720 to minimize the interruption to revenue service upon installation or maintenance activity.

The object controller 714 is connected to the existing legacy system 704 by a wired connection 712 and to the CBTC system 706 by a wireless connection 722 via the cutover unit 708.

When the cutover unit 708 is in the "Legacy" state, the existing legacy system 704 is in control while the state of the trackside devices 716 is still available to the CBTC system 706.

PICO tests of the CBTC system control over the trackside devices 716 are performed during non-revenue hours or if the system is 24/7 during off-peak revenue hours. PICO tests are tests conducted to ensure that the installation work is done in accordance with the installation design instructions, procedures and manuals. The object controller 714 is connected to significantly fewer trackside devices 716 than the existing legacy system 704. Therefore, the PICO test requires less time per object controller 714.

Figure 8:
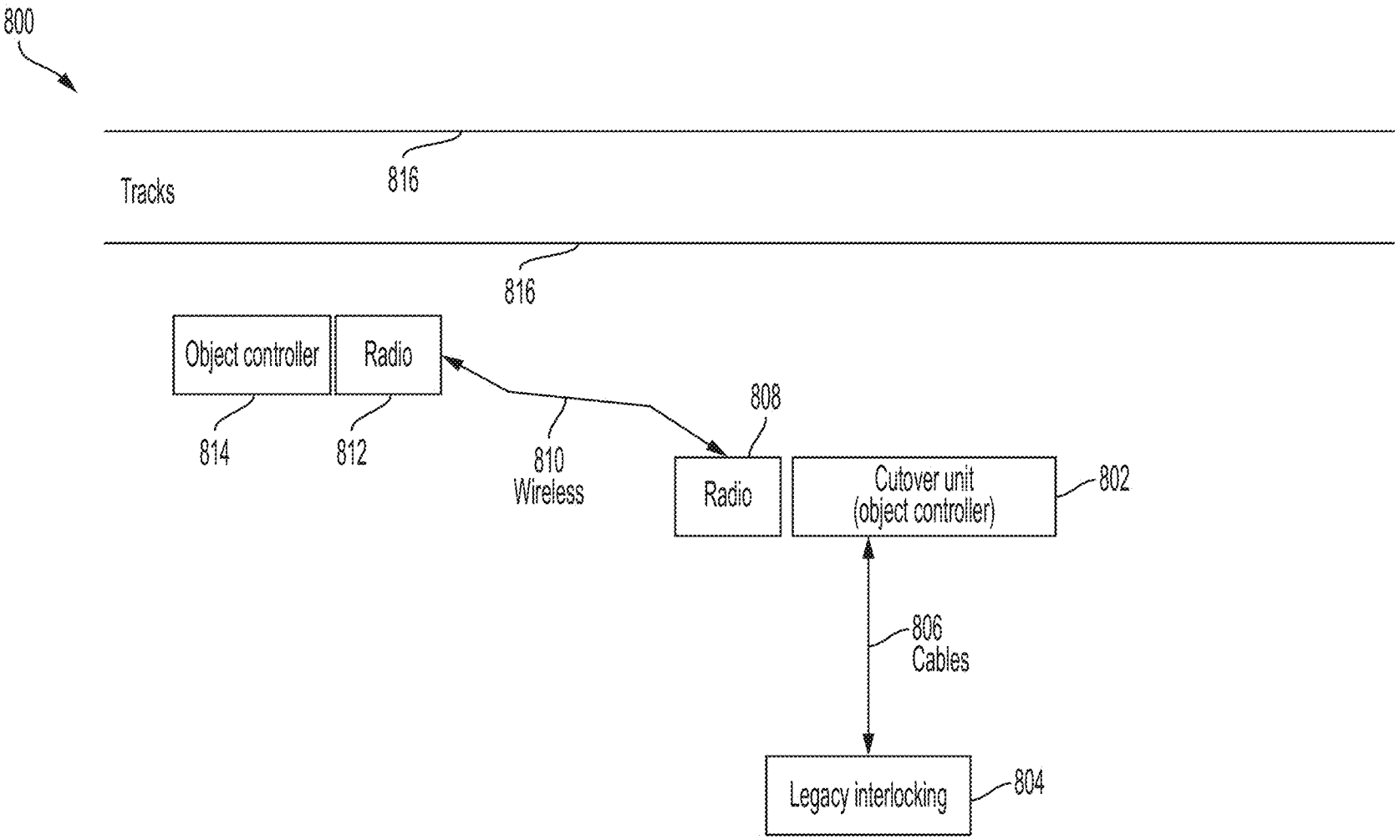
FIG. 8 is a diagram of a remote object controller cutover unit, in accordance with some embodiments.

FIG. 8 is a diagram of a remote object controller cutover system 800, in accordance with some embodiments. A remote object controller cutover unit 802 is connected by cables 806 to a legacy interlocking room 804. The remote object controller cutover unit 802 communicates through a radio unit 808 through a wireless communication 810 to a remote radio unit 812 connected to an object controller 814 positioned in the field, near tracks 816.

Object controllers 814 are installed according to an installation schema with preference to install the object controllers nearby the tracks 816, i.e. not between the two running rails as close as possible to the tracks. Such locations are the interlocking rooms 804 or interlocking machine rooms along the tracks 816, in accordance with some embodiments.

Wired 806 or wireless intra-vehicle network 810 or inter-vehicles network (not shown), for multi-vehicles train consist, are prepared in advance in such a way that the actual installation time is minimized and could be completed within a short time window (less than 4 hours) reducing the number of trainlines wires or eliminating trainlines wires.

Figure 9:
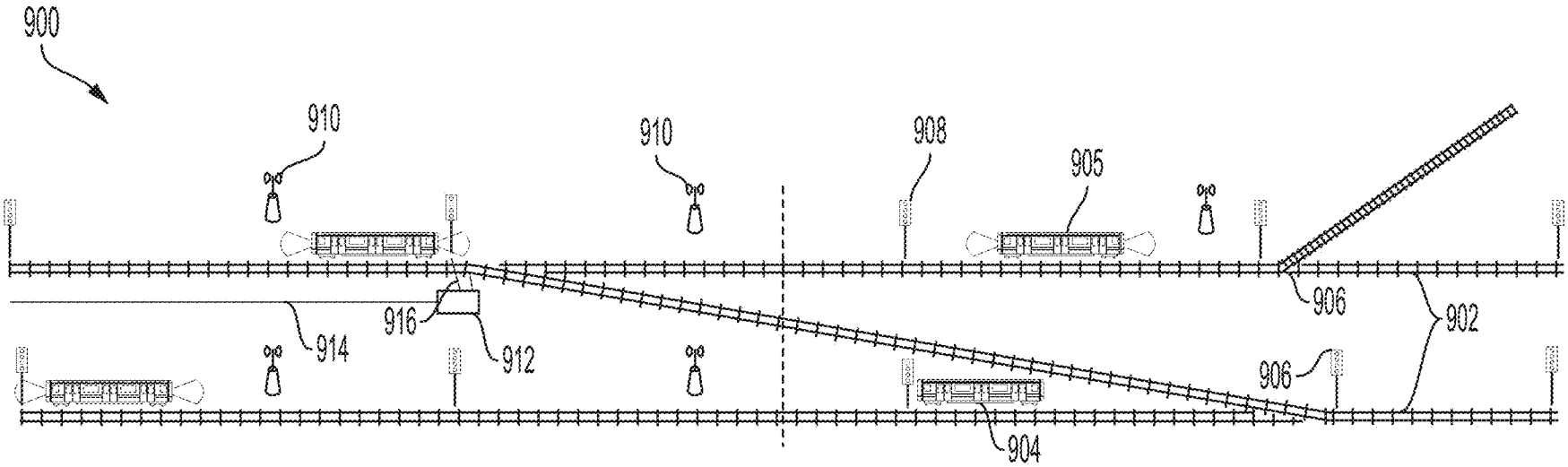
FIG. 9 is a top view of a guideway topology after progressive installation of CBTC object controllers and interfaces to trackside devices, in accordance with some embodiments.

FIG. 9 is a top view of a guideway topology 900 after progressive installation of CBTC object controllers and interfaces to trackside devices, in accordance with some embodiments. The guideway topology 900 includes tracks 902, a legacy vehicle 904, retrofit vehicles 905, switches 906, signals 908 and CBTC trackside equipment 910. The legacy system control and power come from an existing signaling room. A CBTC system object controller 912 communicates with a fiber optic connection 914 and UWB radio link 916.

Figure 10:
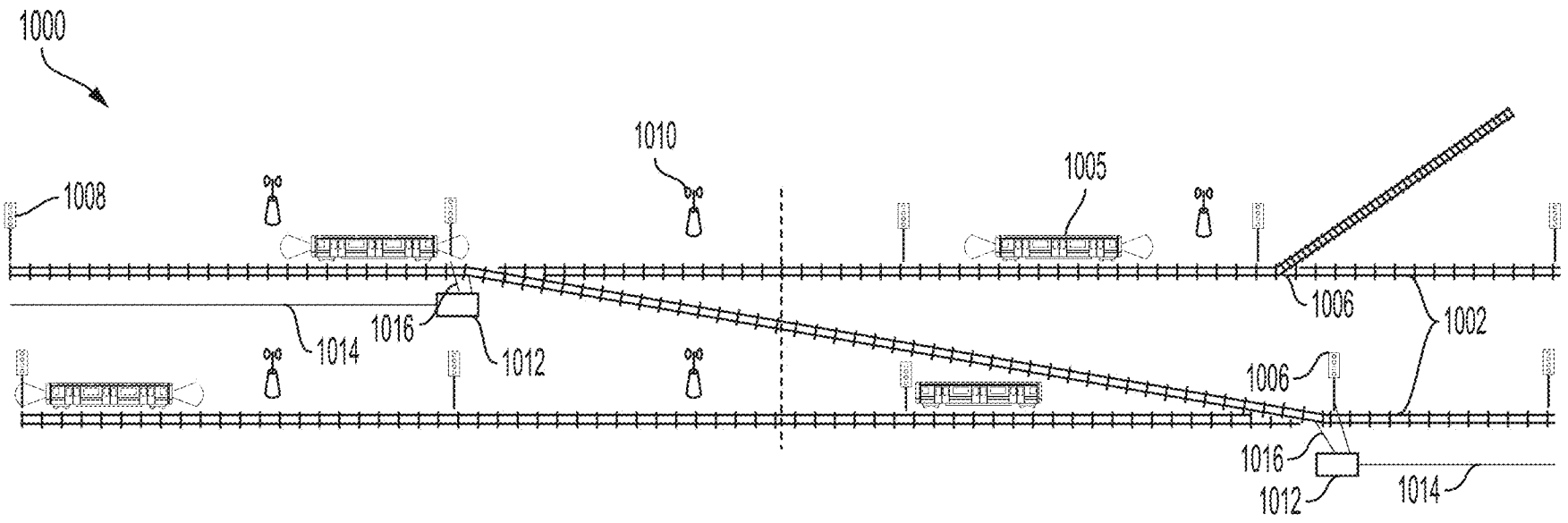
FIG. 10 is a top view of a guideway topology after progressive installation of CBTC object controllers and interfaces to trackside devices, in accordance with some embodiments.

FIG. 10 is a top view of a guideway topology 1000 after further progressive installation of CBTC object controllers and interfaces to trackside devices, in accordance with some embodiments. The guideway topology 1000 includes tracks 1002, retrofit vehicles 1005, switches 1006, signals 1008 and CBTC trackside equipment 1010. A CBTC system object controller 1012 communicates with a fiber optic connection 1014 and UWB radio link 1016.

Figure 11:
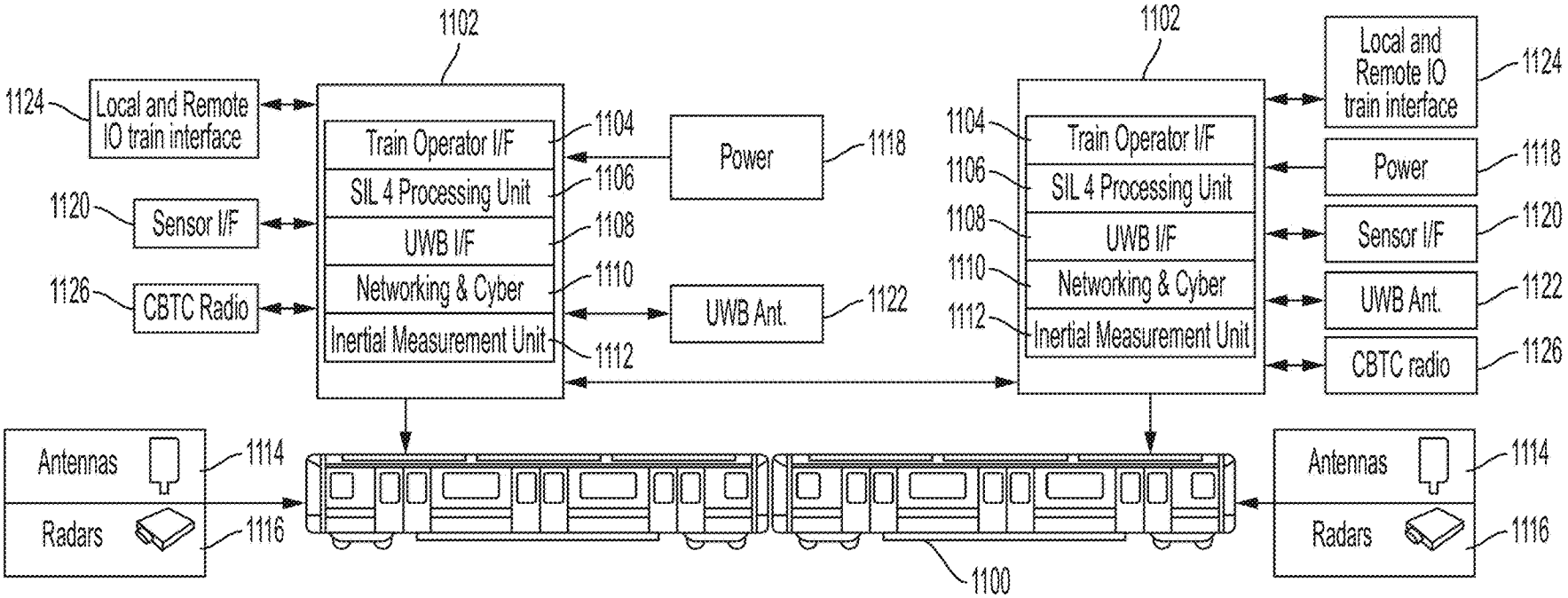
FIG. 11 is a side view of a vehicle with a complete CBTC retrofit, in accordance with some embodiments.

FIG. 11 is a side view of a vehicle 1100 with a complete CBTC retrofit, in accordance with some embodiments. At each end of the vehicle 1100, a CBTC autonomy platform, i.e., a CBTC on-board control system, 1102 is installed to provide the vehicle 1100 with ATO and ATP capabilities. The autonomy platform 1102 includes a train operator interface 1104, a SIL 4 processing unit 1106, an ultra-wideband (UWB) interface 1108, networking and cyber hardware 1110 and an inertial measurement unit 1112. The autonomy platform 1102 is connected to a power source 1118, a sensor interface 1120, a local and remote IO train interface 1124, a CBTC radio 1126 and an UWB antenna 1122. Communication hardware, including antennas 1114 and radars 1116 are installed at each end of the vehicle 1100. The autonomy platforms 1102 are communicably connected together.

Figure 12:
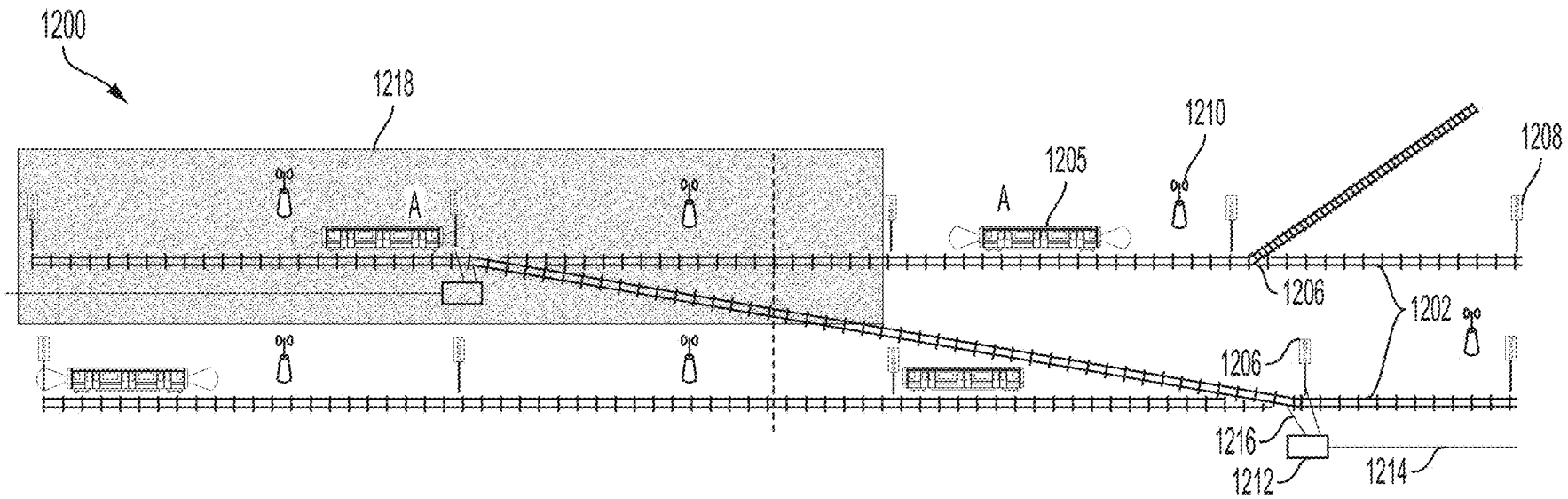
FIG. 12 is a top view of a guideway topology to demonstrate CBTC system commissioning, in accordance with some embodiments.

FIG. 12 is a top view of a guideway topology 1200 to illustrate a stage of retrofitting where a portion of the guideway topology 1200 has a commissioned CBTC system, in accordance with some embodiments. The guideway topology 1200 includes tracks 1202, retrofit vehicles 1205, switches 1206, signals 1208 and CBTC trackside equipment 1210. A CBTC system object controller 1212 communicates with a fiber optic connection 1214 and UWB radio link 1216. The method supports an incremental approach that provides an incremental benefit as each train, i.e., vehicle 1205, is converted and as each incremental section of track 1218 is converted. The shaded area 1218 represents a geographical area that has been converted to CBTC control. The A above trains 1205 indicates that the trains have been completely retrofit and are under autonomous control.

Figure 13:
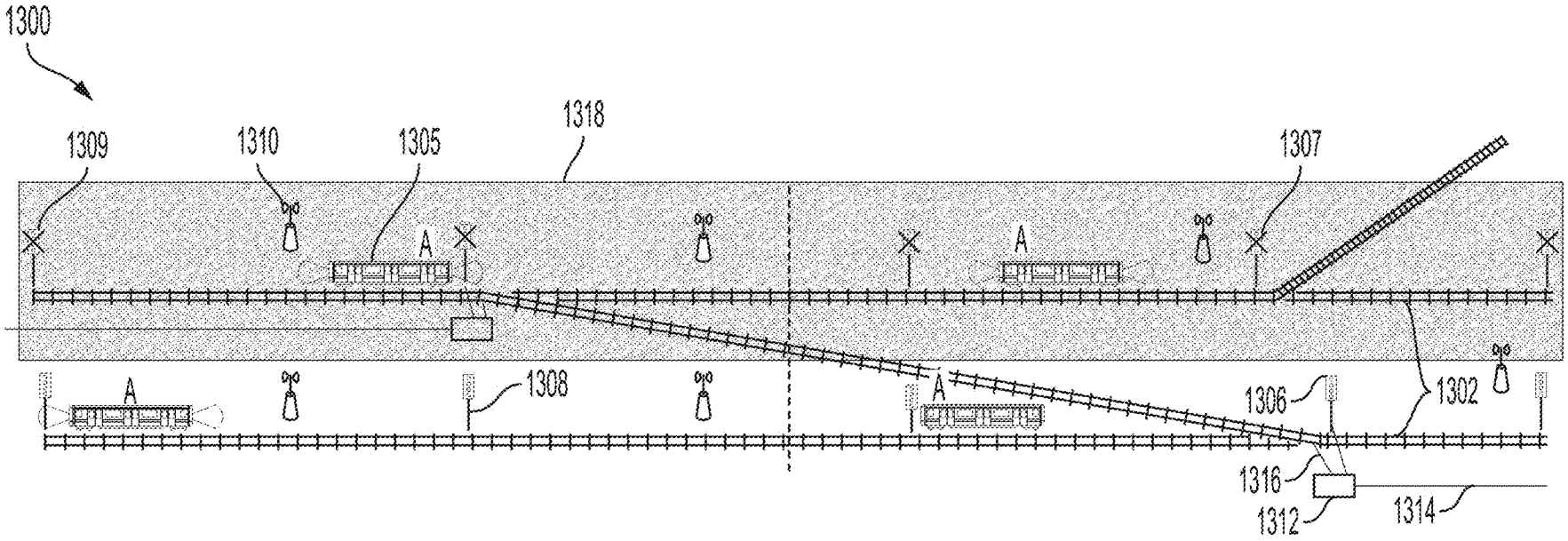
FIG. 13 is a top view of a guideway topology to demonstrate CBTC system commissioning and legacy system decommissioning, in accordance with some embodiments.

FIG. 13 is a top view of a guideway topology 1300 to illustrate another stage of retrofitting where a portion of the guideway topology has been converted to CBTC control and part of the legacy system has been decommissioned, in accordance with some embodiments. The guideway topology 1300 includes tracks 1302, retrofit vehicles 1305, switches 1306, decommissioned switched 1307, signals 1308, decommissioned signals 1309 and CBTC trackside equipment 1310. A CBTC system object controller 1312 communicates with a fiber optic connection 1314 and UWB radio link 1316. The shaded area 1318 represents a geographical area that has been converted to CBTC control, i.e. where the CBTC system has been commissioned and the legacy system has been decommissioned. The A above trains 1305 indicates that the trains have been completely retrofit and are under autonomous control.

Figure 14:
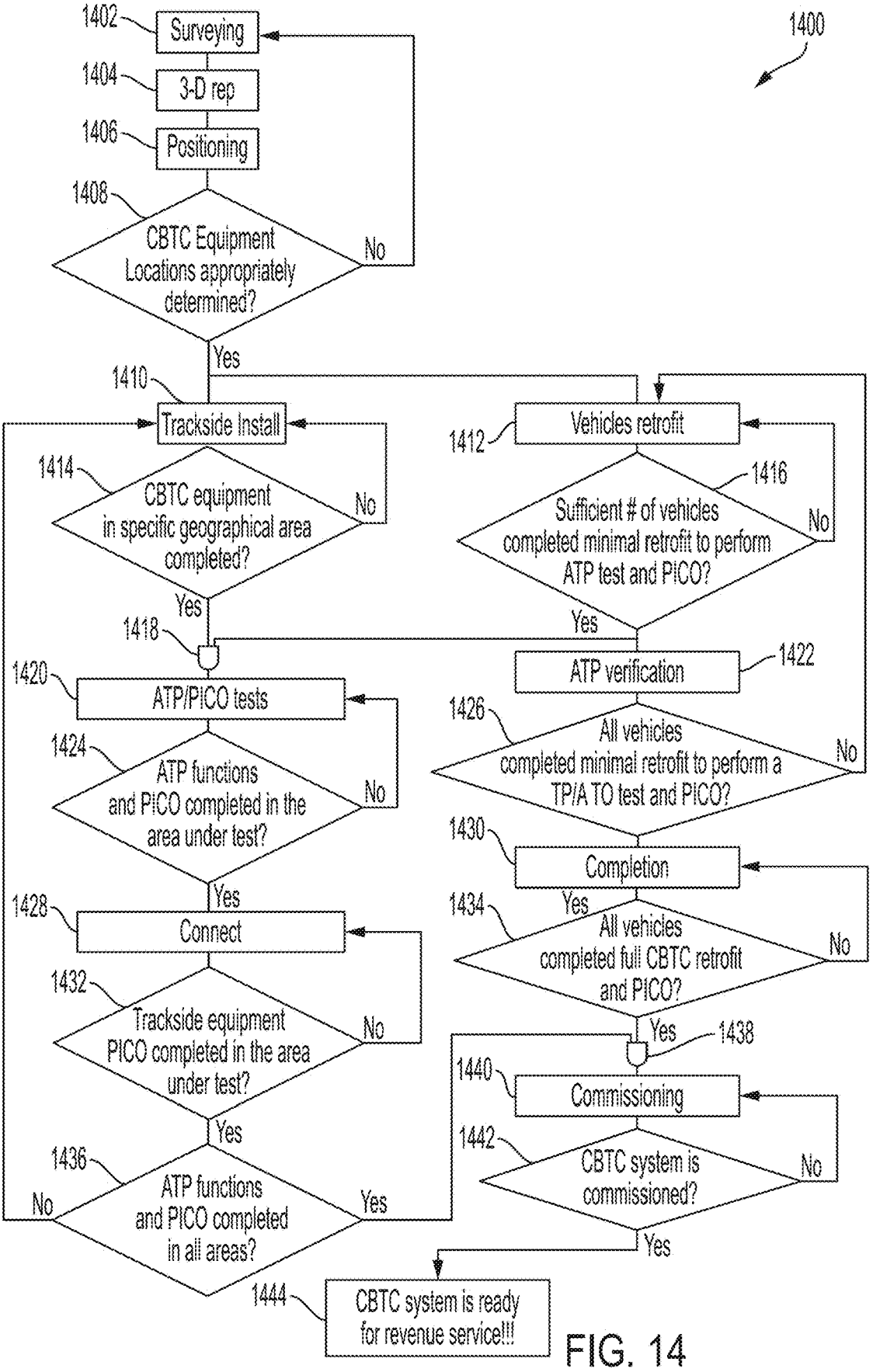
FIG. 14 is a flow chart of a deployment, migration, and cutover process, in accordance with some embodiments.

FIG. 14 is a flow chart of a deployment, migration, and cutover process 1400, in accordance with some embodiments. The CBTC system migration method, in accordance with an embodiment, begins with installing and operating surveying equipment at step 1402. The surveying equipment typically consists of multiple high performance LiDARs, cameras, global positioning system (GPS), tachometer, IMU and a computer, on a vehicle, i.e., vehicle 400. In accordance with an embodiment, the vehicle is a test vehicle or a revenue vehicle adapted to carry this equipment.

The vehicle scans the entire guideway, collecting measurements from the surveying equipment which are logged in the computer with a timestamp. The collected measurements includes, but not limited to, 3-D point cloud data from the LiDARs, 2-D images from the cameras, speed and position from the GPS, speed and displacement from the tachometer, and 3-D acceleration, angular speed and magnetic compass direction from the IMU. The sensors also include spectrum analyzers or equivalent to measure background noise levels for communications.

The survey collects data reflecting the legacy signaling system "as is". No CBTC equipment is yet installed. FIG. 1 depicts an exemplary legacy-equipped guideway topology 100.

The CBTC system migration method proceeds to step 1402, processing the data collected in the step 1402 to calculate a 3-D representation of the tracks centerline, the ECEF coordinates of each guideway element such as signal, trip stop, switch toe point, switch heel point, or the like and the LOS range at each guideway location in both guideway directions.

The CBTC system migration method continues with step 1406, the step of extracting track topology and identifying permanent landmarks that are used as reference points for a positioning algorithm. The positioning algorithm determine suitable locations for CBTC trackside equipment 210 including radios, radar's retroreflectors, camera's signs, LiDAR's retroreflectors and UWB beacons. The positioning algorithm determine the suitable locations for each piece of trackside equipment 210 so that the trackside equipment 210 is able to provide CBTC functionality. For example, the positioning algorithm determines radio placement based on range and radio interference, while signs will be placed based on the LOS range calculation from every given point along the track to the sign. Railway radios, radars, cameras, LiDARs and UWBs operate based on LOS, therefore the positioning algorithm considers the LOS ranges between the tracks and the CBTC trackside equipment, with sufficient overlap of the LOS ranges to ensure that the minimum number of devices is used to get the maximum performance.

At decision block 1408, the CBTC system migration method determines if the CBTC trackside equipment needed to commission the CBTC system has a suitable location. If suitable locations for all the required CBTC trackside equipment is not be determined, the process returns to 1402 and more data is collected.

When suitable locations have been determined for all the necessary CBTC trackside equipment, a CBTC system database and map is generated. In some embodiments, the CBTC system database is updated with CBTC trackside equipment locations as suitable locations are determined. The method proceeds in parallel to step 1410 and step 1412.

The CBTC system migration method proceeds to step 1410, progressive installation of CBTC trackside equipment 210, i.e., CBTC trackside equipment 210, including radios, radar's retroreflectors, camera's signs, LiDAR's retroreflectors, and UWB beacons on the trackside to minimize the interruption to revenue service. These devices are relatively small compared to the signals used in legacy systems and do not require installation between the two rails of the tracks which minimizes the installation time and interruption to revenue service.

Power and fiber optic cables, i.e., fiber optic cables 612, required for the radios and UWB beacons will be prepared in advance and progressively installed in concert with the radios and UWB beacons. In accordance with an embodiment, installation starts from the platform areas and expands progressively outside of the platform areas until completion. FIG. 2 depicts the progressive installation of CBTC equipment 210.

The CBTC system migration method also proceeds to step 1412, progressive retrofitting vehicles 300 to equip the vehicles with communication radios, radars, IMU, cameras, LiDARs, UWB beacons and an on-board computer determining positioning and speed of the vehicle, controlling the propulsion and braking demands and other IO devices such as EB, doors, or the like.

As the retrofit progresses, some vehicles 300 have a complete retrofit while for other vehicles 400 the retrofit take an incremental approach in which only the 416 sensors are installed with a non-SIL computer 406 with the goal to verify the system communications and ATP functions such as positioning and speed determination performance using the on-board sensors 416.

As the retrofit progresses, some vehicles 300 are retrofitted with a SIL 4 processor, sensors and minimal ATP interface, i.e., an emergency braking (EB) interface to the train 300 such that the retrofit vehicles are equipped to ensure that these vehicles 300 have ATP reactions in the event of overrunning signals or movement authority limits or exceed permitted velocities. The vehicles 300 are equipped with ATO capabilities to allow autonomous driving scenarios. FIGS. 3 and 4 depicts stages of a progressive vehicle retrofit to the CBTC system.

After step 1410, the method proceeds by determining from installation records, the CBTC database and the map if the CBTC equipment installation in a specific geographical area has been completed at decision block 1414. If the CBTC equipment installation in a specific geographical area has not been completed, the process returns to repeat step 1410. After step 1412, the method proceeds by determining from installation records if the number of vehicles have completed a minimal number of retrofitted vehicles that is sufficient to perform a post-installation check out (PICO) on the CBTC trackside equipment and to verify the expected performance of the ATP functions at decision block 1416. If a sufficient number of vehicles have not completed a minimal retrofit to perform PICO and the expected performance of the ATP functions are verified, the process returns to repeat step 1412.

At decision block 1414, the method determines if both the CBTC equipment installation in a specific geographical area has been completed based on comparison with installation records, the CBTC database and map, and if the number of vehicles 400 that have completed a minimal retrofit is sufficient to perform PICO and verify the expected performance of the ATP functions, the method continues to step 1420. If the number of vehicles 400 that have completed a minimal retrofit is sufficient to perform PICO and verify the expected performance of the ATP functions, the method continues in parallel to step 1422.

At step 1420, as the retrofit progresses, vehicles 400 that are equipped with high accuracy positioning and speed determination sensors are used to serve as a ground truth system to confirm the CBTC system performance against the ground truth and the correctness of the CBTC database and map against the trackside installed equipment location measured by the ground truth system.

The measurements and the positioning, speed and communications data collected during the PICO verification is logged and transferred to the CBTC data collection system, located either on site or in a remote location, preferably via wireless communication for further analysis and approval of the installation and functionality of the CBTC fundamental functions.

The method determines, at decision block 1424, if the ATP functions and PICO have been completed in the area under test 1218. If the ATP functions and PICO have not been completed in the area under test 1218, the process returns to repeat step 1420. If the ATP functions and PICO have been completed in the area under test, the process continues to step 1428.

At step 1428, the method performs a trackside progressive retrofit to connect trackside devices 716 (e.g. switch, signal, platform doors, trip stop, etc.) into the CBTC system 706.

The object controllers, i.e., object controller 814, for a CBTC system connect to fewer trackside devices than each existing legacy controller. The object controllers 814 are incrementally installed, geographical area 1218 by geographical area, near the tracks 202 but sufficiently far from the tracks to minimize the interruption to revenue service due to the smaller size of the object controller 814 and fewer IOs.

The object controllers, i.e., object controllers 714, include a radio 1510 for wireless communication 722 with the CBTC system 706 and a cutover unit 708 for wire connection 712 to the existing legacy system 704. The object controller 714 also contains a switch, which is a physical switch or a logical switch, with two states: "Legacy" state in which the existing legacy system is in control and "CBTC" state in which the CBTC system is in control. In accordance with some embodiments, the object controller 714 is equipped with sensors such as axle counters, radars, LIDARs, UWBs and cameras to support secondary vehicle tracking.

The cutover unit 708 is at the same location as the object controller or in a different location closer to the existing interlocking system location (typically at the equipment room 602). In this case, the cutover unit is another object controller, which in one end interfaces to the legacy interlocking via wired interface and in the other end interfaces to the object controller near the trackside via wireless link or wired link (fiber optic).

To provide testing of the CBTC system before the CBTC system has been commissioned, the CBTC system receives the trackside device status during train operation, even though the legacy system is operational and used to control the train.

PICO tests to confirm that the CBTC system 706 correctly determines the state of the trackside devices 716 is performed without interruption to revenue service while the existing legacy system 704 is in control. PICO tests to confirm that the CBTC system 706 correctly control the trackside devices 716 is performed during non-revenue hours or if the system is a 24/7 system during off-peak revenue hours with minimal interruption to revenue service.

Cables 712 running from the cutover unit 708 to the equipment room 702 are decommissioned after successful completion of the CBTC system PICO tests and commissioning of the CBTC system.

The method continues to decision block 1432 and determines if the trackside equipment PICO has been completed in the area under test. If the trackside equipment PICO has not been completed in the area under test, the process repeats step 1428. If the trackside equipment PICO has been completed in the area under test, the process continues to decision block 1436 and determines if the ATP functions and PICO have been completed for all areas. If the ATP functions and PICO have been not been completed for all areas, the process returns to repeat step 1414 for the remaining geographical areas.

The method proceeds with step 1422, the step of a progressive ATO function verification. Once the confidence in the CBTC ATP functions is satisfactory then the ATO function PICO tests are performed.

The existing legacy trackside system 704 is still in control over trackside devices 716 ensuring safe separation between vehicles, the CBTC on-board controller 1106 is controlling the propulsion and braking system. The EB is triggered by conventional ATP capabilities (such as a trip arm) or controlled by new on-board system.

The speed profile controlled by the ATO function is verified against the intended speed profile checking that over speeding (moving at a speed that exceeds the maximum safe speed) does not occur. The stopping accuracy in the platforms is verified using the ground truth system based on high accuracy positioning and speed determination sensors with which the retrofit vehicles are equipped.

The method proceeds to decision block 1426 and determines if all vehicles have completed a minimal retrofit to perform ATP/ATO tests and PICO. If all vehicles have not completed a minimal retrofit to perform ATP/ATO tests and PICO, the process returns to step 1412. If all vehicles have completed a minimal retrofit to perform ATP/ATO tests and PICO, the method proceeds to step 1430.

At step 1430 the method proceeds with the progressive completion of vehicles CBTC retrofit. The SIL 4 CBTC on-board controller 1106, vehicle network 1110 and vehicle interfaces 1104 such as EB, doors, propulsion, braking, or the like are installed on every vehicle in the fleet.

The vehicle network 1110 is a wired network or wireless network. Wireless network is easier to install as compared to a wired network, and the installation is completed in shorter time, however a wireless network requires additional cybersecurity. In particular, a wireless network has significant advantages for a multi-vehicle train consist because no wires will have to pass through the coupler's umbilical connectors thereby simplifying installation.

A remote IO vehicle interface unit 1124 is used to distribute the on-board functionality. In at least some embodiments, every on-board controller 1102 is connected to every interface on the vehicle including the case of a multi-vehicle train consist.

Each vehicle is PICO tested to verify the readiness of the vehicle to CBTC operation. FIG. 11 shows an example of train that has undergone a complete CBTC retrofit.

The method proceeds to decision block 1434 to determine if all vehicles 300 have completed the full CBTC retrofit and PICO. If all vehicles 300 have not completed the full CBTC retrofit and PICO, the process returns to step 1430. If, at decision block 1438, all vehicles 300 have completed the full CBTC retrofit and PICO and the ATP functions and PICO have been completed in all geographical areas (from decision block 1436), the method proceed to step 1440.

Step 1440 is the progressive completion of CBTC system commissioning. All vehicles 300 are tested to verify the CBTC on-board ATP functions and ATO functions operate as expected, all object controllers 714 function as expected, movement authority is provided ensuring safe separation between vehicles 300 and the CBTC system 706 expected performance in terms of travel time, headway and stopping accuracy is met. FIGS. 12 and 13 are an example of complete CBTC commissioning and de-commissioning of the legacy system.

The method proceeds to decision block 1442 and determines, using the installation records, the CBTC database and map, the PICO tests and ATO/ATP tests, if the CBTC system is ready to be commissioned. If the CBTC system is not ready to be commissioned, the process returns to step 1442. If the CBTC system is ready to be commissioned, the method proceeds to step 1444 where the CBTC system is commissioned and ready to provide revenue service. Upon completion the existing legacy system is de-commissioned.

Figure 15:
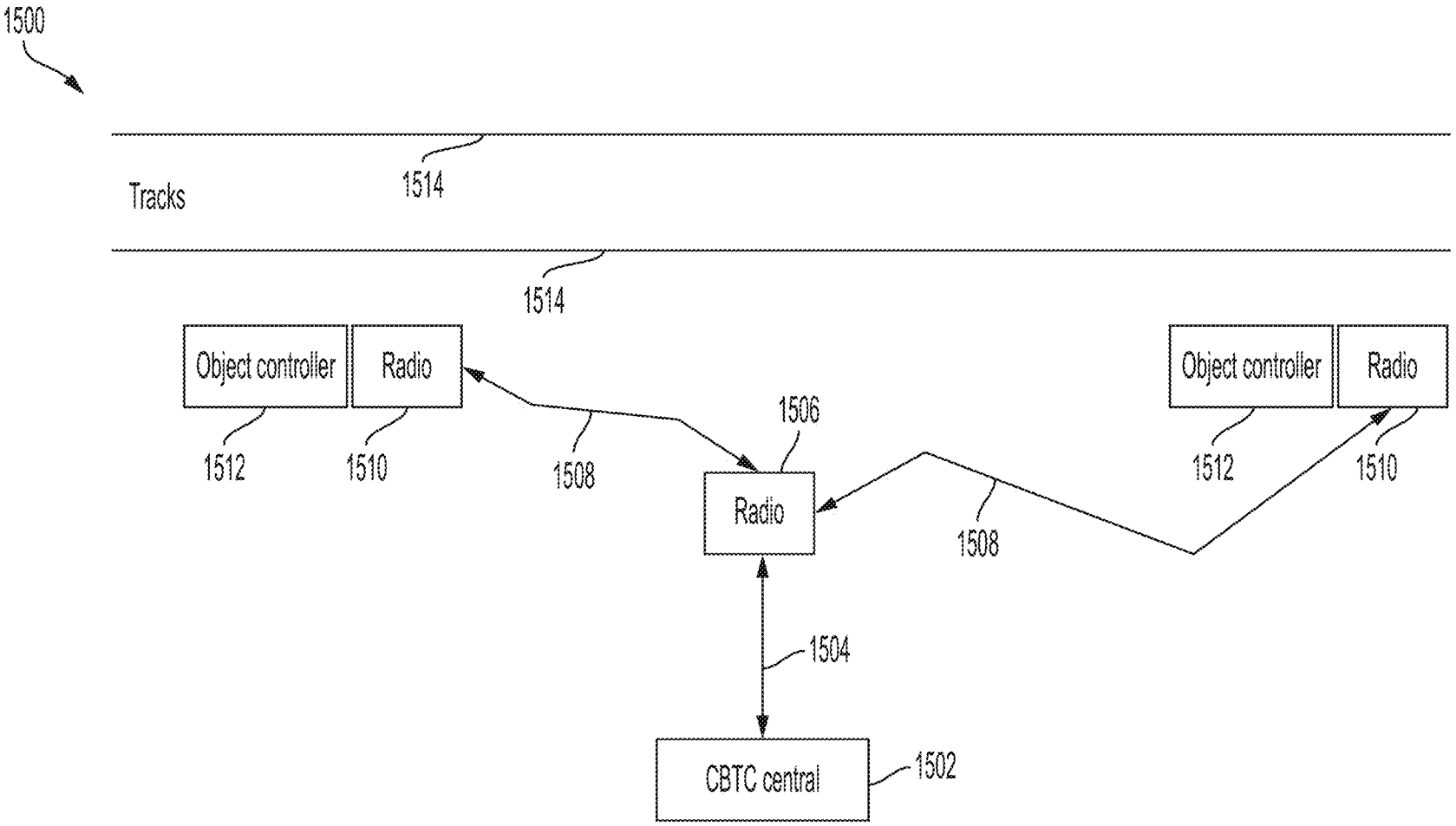
FIG. 15 is a diagram of communications between object controllers and CBTC system, in accordance with some embodiments.

FIG. 15 is a diagram of communications 1500 between object controllers and CBTC system, in accordance with some embodiments. The CBTC central 1502 is connected by fiber optic cable 1504 to a radio 1506. The radio 1506 acts as a communication distribution point, communicating through a wireless network 1508 with remote radios 1510 connected to object controllers 1512 positioned near tracks 1514.

The communications between the object controllers 1512 and the CBTC system 1502 is wireless 1508 via radios 1506, 1510. The communications between the object controllers 1512 and the CBTC central 1502 is either wired (fiber optic) 1504 or in some cases a hybrid between wired and wireless communications. Wireless communications 1508 are enabled between the object controller 1512 and a communication distribution point 1505 and wired connections 1504 are enabled from the communication distribution point 1508 and the CBTC central 1502. The advantage of such schema is that fiber optic cables 1504 are not installed nearby the tracks 1514.

The CBTC system migration method provides an incremental approach to migrate a legacy system into a CBTC signaling system in an effective and efficient manner, within a shorter period of time than previous migration methods. Because the method is incremental, the end user experiences less inconvenience than are experienced under migration methods that are not incremental. The costs of the incremental migration are less than the costs of a non-incremental migration because the interruption to the revenue service during the migration period is reduced. PICO tests are performed using revenue vehicles 300 or special test vehicles 400 during revenue and/or non-revenue hours.

Selection of the radio communication system considers the throughput necessary for CBTC operation with coverage along the complete guideway (typically on the order of a few Mbps <10 Mbps), the throughput necessary for diagnostics and transferring larger data files such as files logged during the guideway survey, typically over 10 Mbps, preferably >50 Mbps. The coverage for this service is not required over the complete guideway but only in designated areas such as designated platforms or depots/yards equipped with dedicated high throughput radios.

When more and more geographical areas are equipped with trackside devices 210 and more and more vehicles 300 are retrofitted with the on-board sensors 316, PICO tests progress to completion when all trackside areas 1218 and all vehicles 1205 are equipped. The CBTC system 706 runs in shadow mode for additional time to build confidence in the position and speed ATP functions. When the propulsion and braking interface is controlled by the CBTC system 706, the ATO function is PICO tested too. When PICO testing of each train 300 is completed, the train is able to operate using train autonomy features. This provides immediate benefits to operation, because rather than waiting until after the first CBTC section 1218 is commissioned. The CBTC system migration method, in accordance with an embodiment, allows progressive installation and PICO tests of object controllers 714 along the tracks.

The object controllers 714, with their cutover unit 708, are installed nearby the tracks 720 in interlocking rooms or interlocking machine rooms (not shown). PICO tests are performed to verify the correctness of the cutover unit 708 and object controller 714 installation are performed in an area by area manner. The turnaround time of such approach is shorter than the turnaround time according to other approaches because each object controller 714 is associated with a smaller geographical area 1218 then a traditional zone controller.

Once the PICO tests of an object controller 714 and cutover unit 708 associated with the object controller 714 are completed, the object controller interface with the CBTC system 706 is verified. The correctness of trackside devices status interpreted by the CBTC system 706 is performed with no interruption to revenue service because the existing legacy system 704 is still in control but the CBTC system 706 receives the status too. The correctness of trackside devices CBTC commands execution result in minimal interruption to revenue service (in particular if the system is a 24/7 system) as vehicles need to slow down or even stop for a short period of time when switch and/or signal aspect override commands are issued.

The CBTC system migration method, in accordance with an embodiment, includes completion of the vehicles' retrofit and PICO tests with SIL 4 on-board controller 302 (or multiple on-board controllers) vehicle network. The PICO tests are performed in the yard/depot.

The CBTC system migration method, in accordance with an embodiment, includes processing of the guideway survey collected data to extract the 3-D representation of the tracks centerline.

The CBTC system migration method, in accordance with an embodiment, includes processing of the guideway survey collected data to extract the location on the map of existing legacy trackside devices 106, 108 such as switch toe, switch heel, signal, trip stop, etc.

The CBTC system migration method, in accordance with an embodiment, includes processing of the guideway survey collected data to extract the LOS distance, in both guideway directions, from each location on the map.

The CBTC system migration method, in accordance with an embodiment, includes processing of the guideway survey collected data to extract the decision where to install CBTC trackside devices 210 such as radios, UWB beacons, retroreflectors and signs based on the LOS distance.

The CBTC system migration method, in accordance with an embodiment, includes preparing Survey equipment installation kit for a typical vehicle that could be used for different projects and during revenue hours of operation.

The CBTC system migration method, in accordance with an embodiment, includes preparing a high throughput radio installation kit for a typical surveying vehicle and a matching trackside radio (or radios) to wirelessly fetch the data collected during the survey without the need to send staff to the surveying vehicle to collect the data.

The CBTC system migration method, in accordance with an embodiment, includes preparing a non-SIL 4 computer 406 suitable for on-board railway environment capable to interface to all CBTC sensors 416 and to the on-board network and radio and perform positioning and speed ATP functions and ATO function during the PICO tests and the ATP and ATO functions confidence buildup period.

The CBTC system migration method, in accordance with an embodiment, includes preparing an installation kit for the trackside devices 210 associated with the CBTC system (radios, UWB beacons, retroreflectors and signs), preferably all installed on the same mast as the radio.

Figure 16:
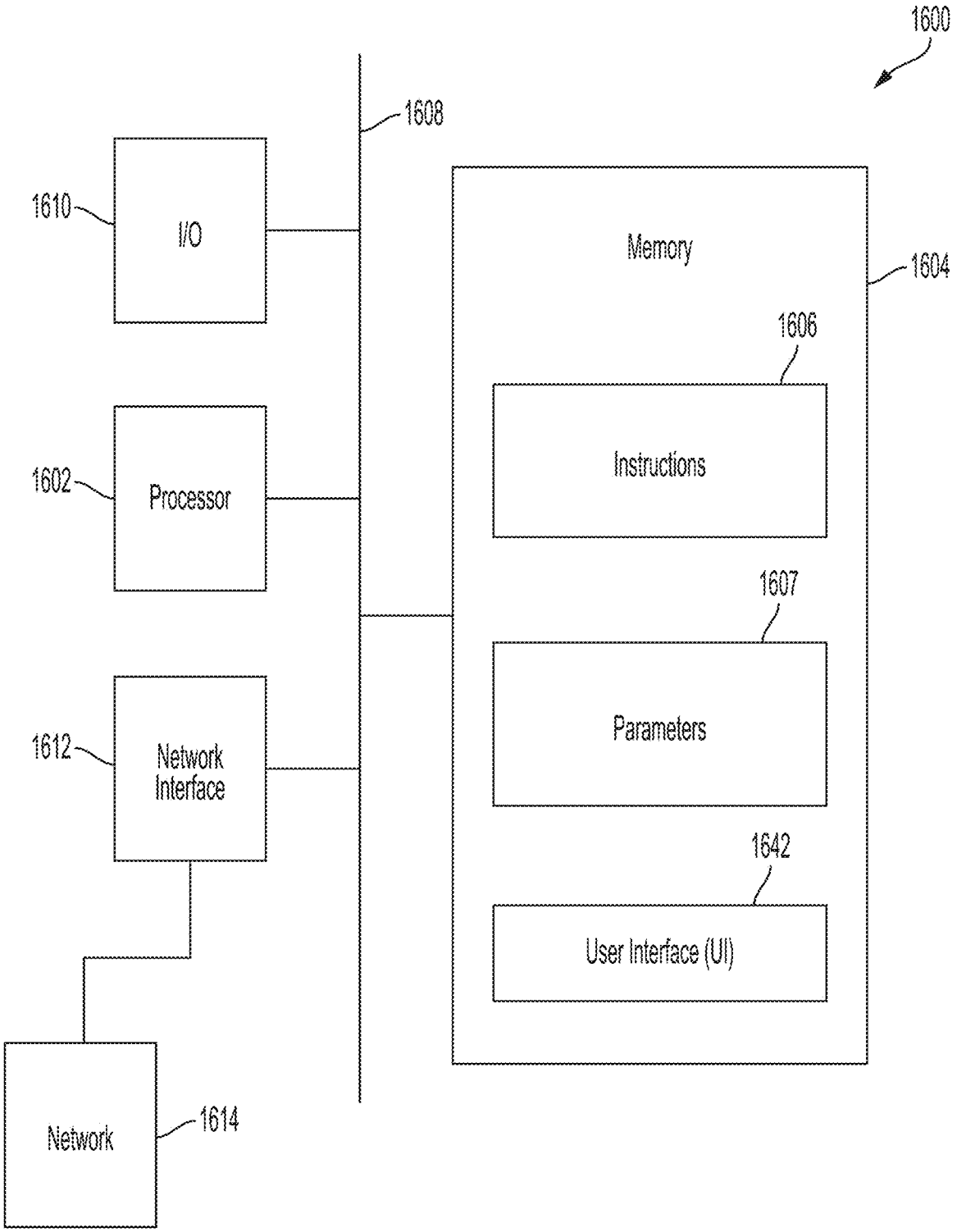
FIG. 16 is a high-level block diagram of a processor-based system usable in conjunction with one or more embodiments.

FIG. 16 is a block diagram of an on-board computer system 1600 in accordance with some embodiments.

In some embodiments, the on-board computer system 1600 is a general purpose computing device including a hardware processor 1602 and a non-transitory, computer-readable storage medium 1604. Storage medium 1604, amongst other things, is encoded with, i.e., stores, computer program code 1606, i.e., a set of executable instructions. Execution of instructions 1606 by hardware processor 1602 represents (at least in part) an on-board computer tool which implements a portion or all of the methods described herein in accordance with one or more embodiments (hereinafter, the noted processes and/or methods).

Processor 1602 is electrically coupled to computer-readable storage medium 1604 via a bus 1608. Processor 1602 is also electrically coupled to an I/O interface 1610 by bus 1608. A network interface 1612 is also electrically connected to processor 1602 via bus 1608. Network interface 1612 is connected to a network 1614, so that processor 1602 and computer-readable storage medium 1604 are capable of connecting to external elements via network 1614. Processor 1602 is configured to execute computer program code 1606 encoded in computer-readable storage medium 1604 in order to cause system 1600 to be usable for performing a portion or all of the noted processes and/or methods. In one or more embodiments, processor 1602 is a central processing unit (CPU), a multi-processor, a distributed processing system, an application specific integrated circuit (ASIC), and/or a suitable processing unit.

In one or more embodiments, computer-readable storage medium 1604 is an electronic, magnetic, optical, electromagnetic, infrared, and/or a semiconductor system (or apparatus or device). For example, computer-readable storage medium 1604 includes a semiconductor or solid-state memory, a magnetic tape, a removable computer diskette, a random access memory (RAM), a read-only memory (ROM), a rigid magnetic disk, and/or an optical disk. In one or more embodiments using optical disks, computer-readable storage medium 1604 includes a compact disk-read only memory (CD-ROM), a compact disk-read/write (CD-R/W), and/or a digital video disc (DVD).

In one or more embodiments, storage medium 1604 stores computer program code 1606 configured to cause system 1600 to be usable for performing a portion or all of the noted processes and/or methods. In one or more embodiments, storage medium 1604 also stores information which facilitates performing a portion or all of the noted processes and/or methods. In one or more embodiments, storage medium 1604 stores parameters 1607.

On-board computer system 1600 includes I/O interface 1610. I/O interface 1610 is coupled to external circuitry. In one or more embodiments, I/O interface 1610 includes a keyboard, keypad, mouse, trackball, trackpad, touchscreen, and/or cursor direction keys for communicating information and commands to processor 1602.

On-board computer system 1600 also includes network interface 1612 coupled to processor 1602. Network interface 1612 allows system 1600 to communicate with network 1614, to which one or more other computer systems are connected. Network interface 1612 includes wireless network interfaces such as BLUETOOTH, WIFI, WIMAX, GPRS, or WCDMA; or wired network interfaces such as ETHERNET, USB, or IEEE-1364. In one or more embodiments, a portion or all of noted processes and/or methods, is implemented in two or more systems 1600.

On-board computer system 1600 is configured to receive information through I/O interface 1610. The information received through I/O interface 1610 includes one or more of instructions, data, design rules, libraries of standard cells, and/or other parameters for processing by processor 1602. The information is transferred to processor 1602 via bus 1608. Train computer system 1600 is configured to receive information related to a UI through I/O interface 1610. The information is stored in computer-readable medium 1604 as user interface (UI) 1642.

In some embodiments, a portion, or all of the noted processes and/or methods, is implemented as a standalone software application for execution by a processor. In some embodiments, a portion, or all of the noted processes and/or methods, is implemented as a software application that is a part of an additional software application. In some embodiments, a portion, or all of the noted processes and/or methods, is implemented as a plug-in to a software application.

In some embodiments, the processes are realized as functions of a program stored in a non-transitory computer readable recording medium. Examples of a non-transitory computer readable recording medium include, but are not limited to, external/removable and/or internal/built-in storage or memory unit, e.g., one or more of an optical disk, such as a DVD, a magnetic disk, such as a hard disk, a semiconductor memory, such as a ROM, a RAM, a memory card, and the like.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

In at least some embodiments, a system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions in at least some embodiments. One general aspect includes a method of communication-based train control system migration. Additionally or alternatively, the method of communication—based train control system migration also includes scanning a guideway to generate surveying data; processing surveying data to calculate a 3-D representation of the guideway including coordinates of guideway elements and line-of-sight range at each guideway element, extracting track topology and identifying landmarks from the 3-D representation of the guideway, determining appropriate locations for communication-based control devices on the guideway using the extracted track topology and identified landmarks, installing a first group of communication-based train control devices in a first portion of the guideway at the determined appropriate locations, retrofitting a first group of vehicles with a communication-based train control autonomy platform and sensors, performing testing of the first group of communication-based train control devices, performing testing of the first group of retrofit vehicles, installing a second group of communication-based train control devices in a second portion of the guideway at the determined appropriate locations, retrofitting a second group of vehicles with a communication-based train control autonomy platform and sensors, performing testing of the second group of communication-based train control devices, performing testing of the second group of retrofit vehicles, and using a communication-based train control system to control the retrofit vehicles when they operate within the first and second portions of the guideway. Other embodiments of this aspect include corresponding computer systems, apparatus, and computer programs recorded on one or more computer storage devices, each configured to perform the actions of the methods.

Implementations, in at least some embodiments, may include one or more of the following features. A method where the guideway scanning is performed using surveying equipment installed on a surveying vehicle. The 3-D representation of the guideway is a 3-D representation of a track centerline. The determined appropriate locations are used to generate a communication-based train control system database and map. The method may include checking installation of the communication-based control devices using the communication-based train control system database and map. The communication-based train control system autonomy platform provides automatic train operation functions. The communication-based control devices are tested using post-installation check-out verification. Implementations of the described techniques may include hardware, a method or process, or computer software on a computer-accessible medium.

In at least some embodiments, a method of communication-based train control system migration includes scanning a guideway to generate surveying data; processing surveying data to calculate a 3-D representation of the guideway including coordinates of guideway elements and line-of-sight range at each guideway element; extracting track topology and identifying landmarks from the 3-D representation of the guideway; determining appropriate locations for communication-based control devices on the guideway using the extracted track topology and identified landmarks; installing a communication-based train control system; installing a first group of communication-based train control devices in a first portion of the guideway at the determined appropriate locations, where the first group of communication-based train control devices communicate with the communication-based train control system; retrofitting a first group of vehicles with a communication-based train control autonomy platform and sensors; performing testing of the first group of communication-based train control devices; performing testing of the first group of retrofit vehicles; installing a second group of communication-based train control devices in a second portion of the guideway at the determined appropriate locations, where the second group of communication-based control devices communicate with the communication-based train control system; retrofitting a second group of vehicles with a communication-based train control autonomy platform and sensors; performing testing of the second group of communication-based train control devices; performing testing of the second group of retrofit vehicles; and using the communication-based train control system to control the retrofit vehicles when they operate within the first and second portions of the guideway. Other embodiments of this aspect include corresponding computer systems, apparatus, and computer programs recorded on one or more computer storage devices, each configured to perform the actions of the methods.

Implementations, in at least some embodiments, may include one or more of the following features. A method where the 3-D representation of the guideway is a 3-D representation of a track centerline. The determined appropriate locations are used to generate a communication-based train control system database and map. The method may include checking installation of the communication-based control devices using the communication-based train control system database and map. The communication-based train control system autonomy platform provides automatic train operation functions. The communication-based control devices are tested using post-installation check-out verification. Implementations of the described techniques may include hardware, a method or process, or computer software on a computer-accessible medium.

In at least some embodiments, a method of communication-based train control system migration includes scanning a guideway to generate surveying data; processing surveying data to calculate a 3-D representation of the guideway including coordinates of guideway elements and line-of-sight range at each guideway element, extracting track topology and identifying landmarks from the 3-D representation of the guideway, determining appropriate locations for communication-based control devices on the guideway using the extracted track topology and identified landmarks, installing a communication-based train control system, installing a first group of communication-based train control devices in a first portion of the guideway at the determined appropriate locations, installing a first group of cutover-units to object controllers connected to a first group of guideway elements, retrofitting a first group of vehicles with a communication-based train control autonomy platform and positioning sensors and speed sensors, performing testing of the first group of communication-based train control devices, performing testing of the first group of retrofit vehicles, installing a second group of communication-based train control devices in a second portion of the guideway at the determined appropriate locations, installing a second group of cutover-units to object controllers connected to a second group of guideway elements, retrofitting a second group of vehicles with a communication-based train control autonomy platform and sensors, performing testing of the second group of communication-based train control devices, performing testing of the second group of retrofit vehicles, and using the communication-based train control system to control the retrofit vehicles when they operate within the first and second portions of the guideway, performing testing of the second group of communication-based train control devices, performing testing of the second group of retrofit vehicles, instructing the first group of cutover-units and the second group of cutover units to switch control of the first group of guideway elements from a legacy system to a communication-based train control system, and using a communication-based train control system to control the retrofit vehicles when they operate within the first and second portions of the guideway. Other embodiments of this aspect include corresponding computer systems, apparatus, and computer programs recorded on one or more computer storage devices, each configured to perform the actions of the methods.

Implementations, in at least some embodiments, may include one or more of the following features. A method where the 3-D representation of the guideway is a 3-D representation of a track centerline. The determined appropriate locations are used to generate a communication-based train control system database and map. The method may include checking installation of the communication-based control devices using the communication-based train control system database and map. The communication-based train control system autonomy platform provides automatic train operation functions. The communication-based control devices are tested using post-installation check-out verification. The first and second groups of cut-over units communicate with the communication-based train control system wirelessly. Implementations of the described techniques may include hardware, a method or process, or computer software on a computer-accessible medium.

What is claimed is:

1. A method of communication-based train control system migration, including the steps of:

scanning a guideway to generate surveying data;

processing surveying data to calculate a 3-D representation of the guideway including coordinates of guideway elements and line-of-sight range at each guideway element;

extracting track topology and identifying landmarks from the 3-D representation of the guideway;

determining appropriate locations for communication-based control devices on the guideway using the extracted track topology and identified landmarks;

installing a first group of communication-based train control devices in a first portion of the guideway at the determined appropriate locations;

retrofitting a first group of vehicles with a communication-based train control autonomy platform and sensors;

performing testing of the first group of communication-based train control devices;

performing testing of the first group of retrofit vehicles;

installing a second group of communication-based train control devices in a second portion of the guideway at the determined appropriate locations;

retrofitting a second group of vehicles with a communication-based train control autonomy platform and sensors;

performing testing of the second group of communication-based train control devices;

performing testing of the second group of retrofit vehicles; and using a communication-based train control system to control the retrofit vehicles when they operate within the first and second portions of the guideway.

2. The method of claim 1, wherein the guideway scanning is performed using surveying equipment installed on a surveying vehicle.

3. The method of claim 1, wherein the 3-D representation of the guideway is a 3-D representation of a track centerline.

4. The method of claim 1, wherein the determined appropriate locations are used to generate a communication-based train control system database and map.

5. The method of claim 4, further comprising checking installation of the communication-based control devices using the communication-based train control system database and map.

6. The method of claim 1, wherein the communication-based train control system autonomy platform provides automatic train operation functions.

7. The method of claim 1, wherein the communication-based control devices are tested using post-installation check-out verification.

8. A method of communication-based train control system migration, including the steps of:

scanning a guideway to generate surveying data;

processing surveying data to calculate a 3-D representation of the guideway including coordinates of guideway elements and line-of-sight range at each guideway element;

extracting track topology and identifying landmarks from the 3-D representation of the guideway;

determining appropriate locations for communication-based control devices on the guideway using the extracted track topology and identified landmarks;

installing a communication-based train control system;

installing a first group of communication-based train control devices in a first portion of the guideway at the determined appropriate locations, wherein the first group of communication-based train control devices communicate with the communication-based train control system;

retrofitting a first group of vehicles with a communication-based train control autonomy platform and sensors;

performing testing of the first group of communication-based train control devices;

performing testing of the first group of retrofit vehicles;

installing a second group of communication-based train control devices in a second portion of the guideway at the determined appropriate locations, wherein the second group of communication-based control devices communicate with the communication-based train control system;

retrofitting a second group of vehicles with a communication-based train control autonomy platform and sensors;

performing testing of the second group of communication-based train control devices;

performing testing of the second group of retrofit vehicles; and using the communication-based train control system to control the retrofit vehicles when they operate within the first and second portions of the guideway.

9. The method of claim 8, wherein the 3-D representation of the guideway is a 3-D representation of a track centerline.

10. The method of claim 8, wherein the determined appropriate locations are used to generate a communication-based train control system database and map.

11. The method of claim 10, further comprising checking installation of the communication-based control devices using the communication-based train control system database and map.

12. The method of claim 8, wherein the communication-based train control system autonomy platform provides automatic train operation functions.

13. The method of claim 8, wherein the communication-based control devices are tested using post-installation check-out verification.

14. A method of communication-based train control system migration, including the steps of:

scanning a guideway to generate surveying data;

processing surveying data to calculate a 3-D representation of the guideway including coordinates of guideway elements and line-of-sight range at each guideway element;

extracting track topology and identifying landmarks from the 3-D representation of the guideway;

determining appropriate locations for communication-based control devices on the guideway using the extracted track topology and identified landmarks;

installing a communication-based train control system;

installing a first group of communication-based train control devices in a first portion of the guideway at the determined appropriate locations;

installing a first group of cutover-units to object controllers connected to a first group of guideway elements;

retrofitting a first group of vehicles with a communication-based train control autonomy platform and positioning sensors and speed sensors;

performing testing of the first group of communication-based train control devices;

performing testing of the first group of retrofit vehicles;

installing a second group of communication-based train control devices in a second portion of the guideway at the determined appropriate locations;

installing a second group of cutover-units to object controllers connected to a second group of guideway elements;

retrofitting a second group of vehicles with a communication-based train control autonomy platform and sensors;

performing testing of the second group of communication-based train control devices;

performing testing of the second group of retrofit vehicles; and using the communication-based train control system to control the retrofit vehicles when they operate within the first and second portions of the guideway;

performing testing of the second group of communication-based train control devices;

performing testing of the second group of retrofit vehicles;

instructing the first group of cutover-units and the second group of cutover units to switch control of the first group of guideway elements from a legacy system to a communication-based train control system; and using a communication-based train control system to control the retrofit vehicles when they operate within the first and second portions of the guideway.

15. The method of claim 14, wherein the 3-D representation of the guideway is a 3-D representation of a track centerline.

16. The method of claim 14, wherein the determined appropriate locations are used to generate a communication-based train control system database and map.

17. The method of claim 16, further comprising checking installation of the communication-based control devices using the communication-based train control system database and map.

18. The method of claim 14, wherein the communication-based train control system autonomy platform provides automatic train operation functions.

19. The method of claim 14, wherein the communication-based control devices are tested using post-installation check-out verification.

20. The method of claim 14, wherein the first and second groups of cut-over units communicate with the communication-based train control system wirelessly.

* * * * *